US010537156B2

(12) United States Patent
Thappeta

(10) Patent No.: US 10,537,156 B2
(45) Date of Patent: Jan. 21, 2020

(54) SHOCK-ABSORBING FOOTWEAR

(71) Applicant: Pradeep Thappeta, Atlanta, GA (US)

(72) Inventor: Pradeep Thappeta, Atlanta, GA (US)

( * ) Notice: Subject to any disclaimer, the term of this patent is extended or adjusted under 35 U.S.C. 154(b) by 0 days.

(21) Appl. No.: 15/854,340

(22) Filed: Dec. 26, 2017

(65) Prior Publication Data

US 2018/0177264 A1 Jun. 28, 2018

Related U.S. Application Data

(60) Provisional application No. 62/438,777, filed on Dec. 23, 2016.

(51) Int. Cl.

| | |
|---|---|
| ***A43B 13/28*** | (2006.01) |
| ***A43C 19/00*** | (2006.01) |
| ***A43B 13/18*** | (2006.01) |

(52) U.S. Cl.

CPC ..... *A43C 19/00* (2013.01); *A43B 13/182* (2013.01); *A43B 13/28* (2013.01)

(58) Field of Classification Search

CPC ..... A43C 19/00; A43B 13/182; A43B 13/184; A43B 13/28

USPC ..... 36/7.8, 27

See application file for complete search history.

(56) References Cited

U.S. PATENT DOCUMENTS

| | | | | | |
|---|---|---|---|---|---|
| 1,402,263 | A * | 1/1922 | Southgate | A63B 25/10 | 36/7.8 |
| 1,670,747 | A * | 5/1928 | Sestito | A63B 25/10 | 36/28 |
| 2,837,840 | A * | 6/1958 | Kerpel | A63B 25/10 | 36/7.8 |
| 3,996,677 | A * | 12/1976 | Reina | A43B 5/18 | 36/7.8 |
| 4,296,557 | A * | 10/1981 | Pajevic | A43B 5/18 | 36/64 |
| 4,457,084 | A * | 7/1984 | Horibata | A43B 5/12 | 36/28 |
| 4,660,299 | A * | 4/1987 | Omilusik | A43B 13/182 | 36/27 |
| 4,912,859 | A * | 4/1990 | Ritts | A43B 13/184 | 36/7.8 |
| D447,330 | S * | 9/2001 | McCourt | D2/972 | |
| 2008/0016716 | A1* | 1/2008 | Battaglino | A43B 13/182 | 36/7.8 |

* cited by examiner

*Primary Examiner* — Ted Kavanaugh

(74) *Attorney, Agent, or Firm* — Bekiares Eliezer LLP

(57) ABSTRACT

Disclosed herein are a shock-absorbing devices and shoes. In one aspect, the shoe encompasses an upper; a sole; and at least one shock-absorbing assembly, the shock-absorbing assembly including: a support frame connected to at least a portion of the upper or sole, and a plurality of shock-absorbing members having first and second opposed ends, the first ends of the shock-absorbing members being connected to a portion of the support frame. Also disclosed herein are methods for dampening an applied force to a joint during walking using the disclosed devices and shoes.

18 Claims, 10 Drawing Sheets

200
202
204
206
208
210
212
214

SHOCK-ABSORBING FOOTWEAR

CROSS REFERENCE TO RELATED APPLICATIONS

This claims the benefit of priority to U.S. Provisional Patent Application Ser. No. 62/438,777, filed Dec. 23, 2016, which is hereby incorporated herein by reference in its entirety.

FIELD OF INVENTION

The present invention relates to methods and devices for shock-absorbing footwear.

BACKGROUND OF THE INVENTION

During walking or running, the feet, leg joints, and lower back have to withstand tremendous amounts of forces acting on them with every stride. The weight acting on the feet, leg joints, and lower back can average between 2 and 5 times the body weight depending on the speed and other factors. While cushioning in the sole and heel area in the current models of shoes achieve softer landing, the impact forces travelling back into the bone structure are still substantial and accumulate with every stride. The negative effects of these impact forces on the body is a significant reason why people with back trouble and knee pain experience more pain after walking or running.

Current footwear use shock absorbing materials and components that are embedded inside the shoe sole or under the sole externally. While this may provide certain energy deflecting capabilities, the impact force reduction to the user is not adequately achieved.

Accordingly, there remains a need for new shock-absorbing footwear and devices which are capable of reducing the applied forces and impact on the body. Additionally, the shock-absorbing footwear and devices should be versatile enough to attach to existing footwear and be adjustable for different users. This need and other needs are satisfied by the various aspects of the present disclosure.

SUMMARY OF THE INVENTION

In accordance with the purposes of the invention, as embodied and broadly described herein, the invention, in one aspect, relates to a shock-absorbing shoe and device for dampening an applied force to a joint, such as during walking.

In an exemplary aspect, the invention relates to a shock-absorbing shoe comprising: an upper; a sole; and a shock-absorbing assembly, the shock-absorbing assembly comprising: a support frame connected to at least a portion of the upper or sole, and a plurality of shock-absorbing members having first and second opposed ends, the first ends of the shock-absorbing members being connected to a portion of the support frame.

In another exemplary aspect, the invention relates to a shock-absorbing assembly for an article of footwear, the shock-absorbing assembly comprising: a support frame configured to connect to at least a portion of the article of footwear, and a plurality of shock-absorbing members having first and second opposed ends, the first ends of the shock-absorbing members being connected to a portion of the support frame.

In another exemplary aspect, the invention relates to a method for dampening an applied force to a joint during walking; the method comprising: providing an article of footwear having a shock-absorbing assembly, the shock-absorbing assembly comprising: a support frame configured to connect to at least a portion of the article of footwear, and a plurality of shock-absorbing members having first and second opposed ends, the first ends of the shock-absorbing members being connected to a portion of the support frame.

In further aspects, the invention also relates to methods for using the disclosed devices and systems.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
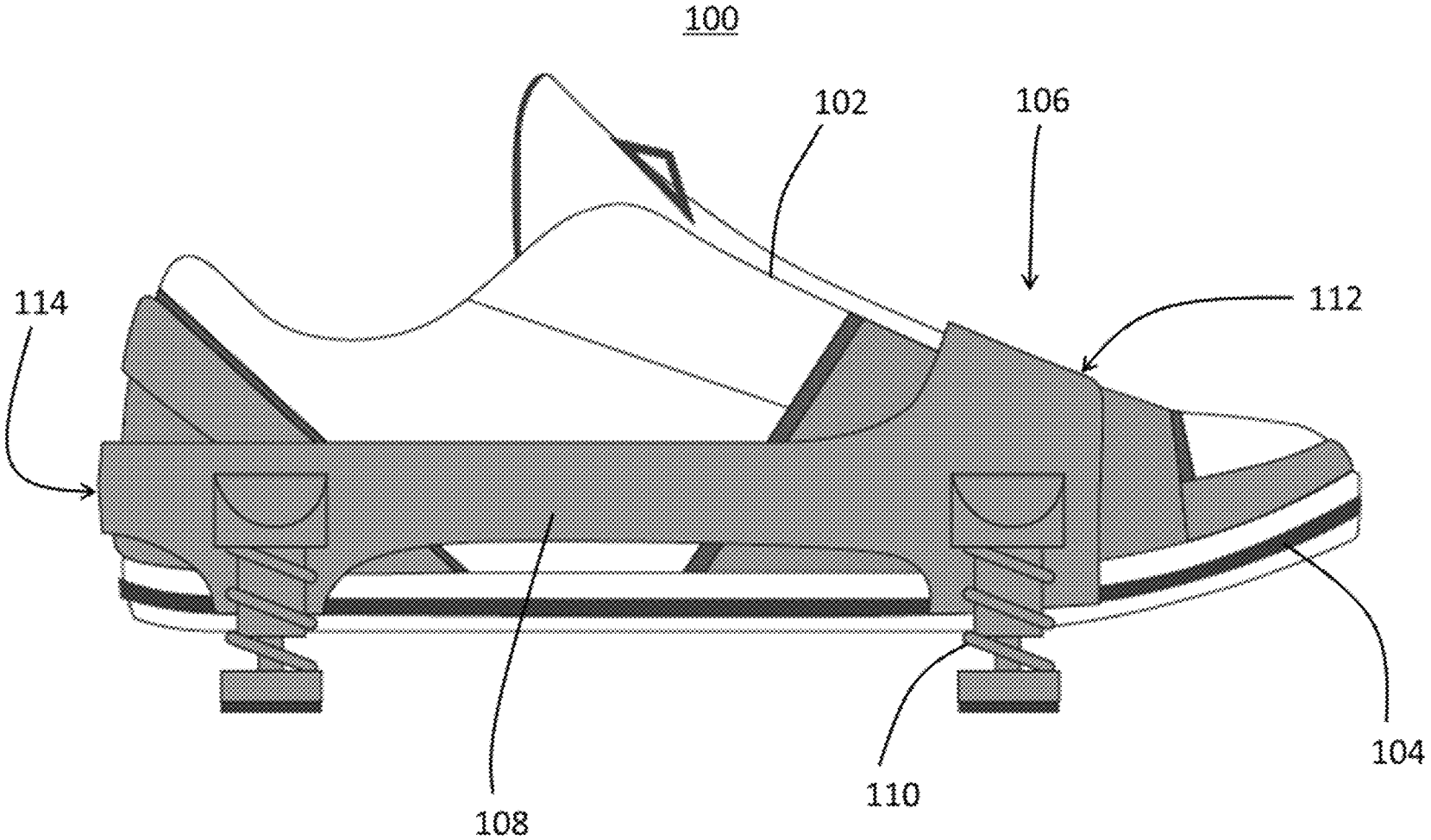
FIG. 1 shows a depiction of a shock-absorbing shoe comprising a shock-absorbing assembly in accordance with an exemplary embodiment of the present invention.
Figures 2A, 2B, 2C, 2D, 2E:
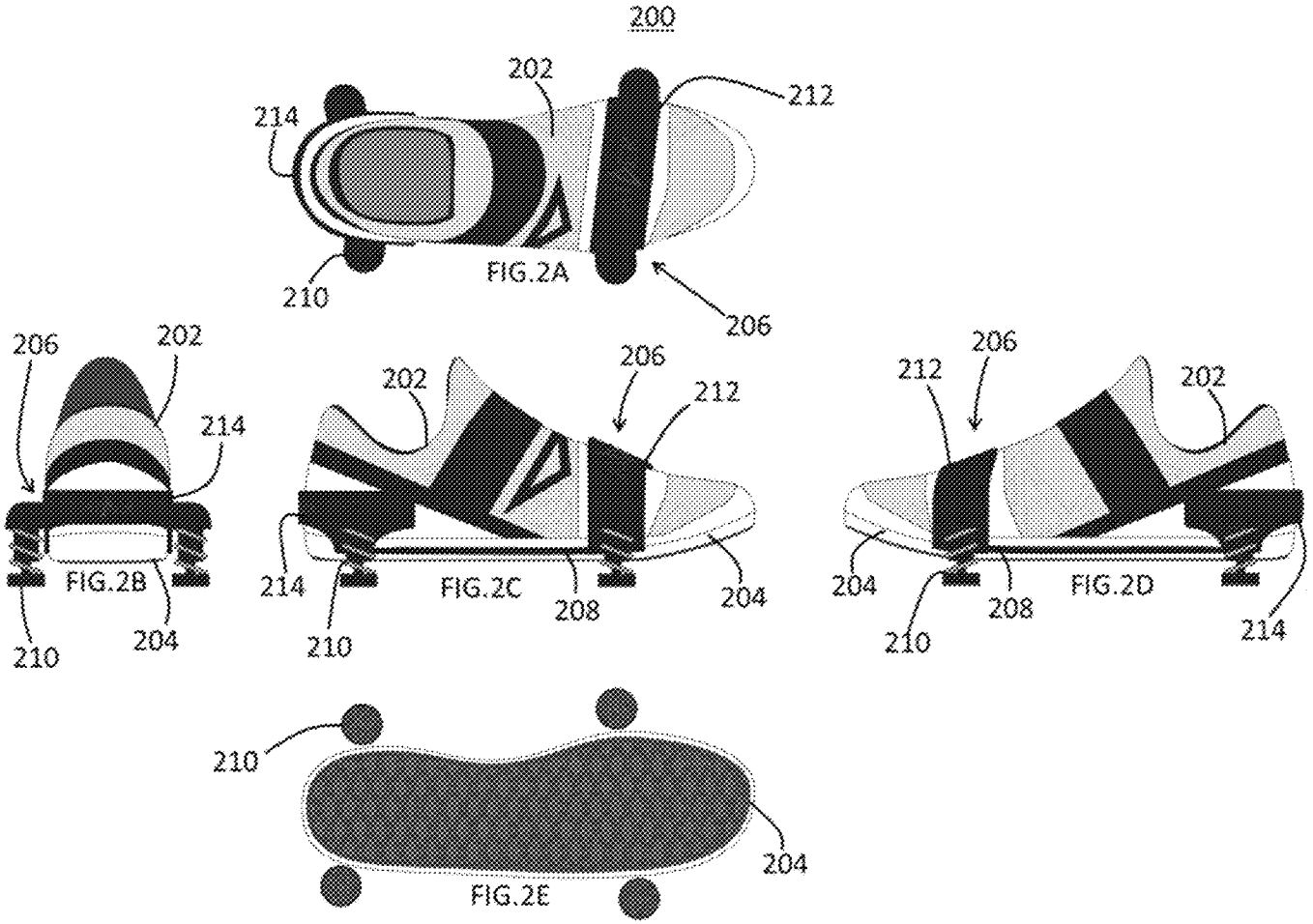
FIGS. 2A-2E show various views depicting of a shock-absorbing shoe comprising a shock-absorbing assembly in accordance with another exemplary embodiment of the present invention.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an assembly" includes two or more assemblies.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

As used herein, the term "footwear" means any type of wearing apparel for the feet, and this term includes, but is not limited to: all types of shoes, boots, sneakers, sandals, thongs, flip-flops, mules, scuffs, slippers, sport-specific shoes (such as running shoes, cross training shoes, golf shoes, basketball shoes, tennis shoes, baseball cleats, soccer or football cleats, ski boots, etc.), and can include any device into which a user places at least some portion of his or her foot.

Disclosed are the components to be used to manufacture the disclosed devices and articles of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

B. Shock-Absorbing Shoe and Device

As briefly described above, the present disclosure relates, in various aspects, to devices and systems for reducing applied forces and impact to a joint, such as during walking or running, or the like. In one aspect, the present disclosure provides a shock-absorbing shoe comprising: an upper; a sole; and at least one shock-absorbing assembly, the shock-absorbing assembly comprising: at least one support frame connected to at least a portion of the upper or sole or a combination thereof, and a plurality of shock-absorbing members having first and second opposed ends, the first ends of the shock-absorbing members being connected to a portion of the support frame.

In various aspects, the support frame can comprise many various configurations and shapes. In further aspects, the support frame can comprise a ball portion and a heel portion. In still further aspects, the ball portion of the support frame can be shaped to be disposed over a top portion of a wearer's foot. In yet further aspects, the heel portion of the support frame can be shaped to be disposed around a back portion of a wearer's foot. In some aspects, the ball portion of the support frame can be disposed over a top portion of the upper. In other aspects, the heel portion of the support frame can be shaped to be disposed around a back portion of the upper. In even further aspects, the heel portion and the ball portion can be connected by a frame member. In some aspects, the support frame may comprise a sole portion. In other aspects, the ball portion and/or the heel portion may further comprise a sole portion. In further aspects, the sole portion may comprise a frame member extending from one side of the shoe to another side of the shoe. In even further aspects, the sole portion may be disposed under a portion of the ball area (e.g., adjacent to the heads of the metatarsal bones) and/or heel area (e.g., adjacent to prominence based on the heel bone at the posterior end of the foot) of a wearer's foot.

In further aspects, the shock-absorbing assembly can comprise a plurality of support frames. In even further aspects, the support frame may comprise a plurality of frame members, each frame member having first and second opposed ends. In still further aspects, at least a portion of a frame member can be connected to the upper, or the sole, or a combination thereof. In some aspects, the plurality of frame members can be connected. In other aspects, the plurality of frame members may not be connected. In further aspects, the plurality of support frames may be connected by a frame member. In still further aspects, the support frames and/or frame members may be detachably connected.

In further aspects, the support frame comprises a first and second frame member. In some aspects, the first and second frame members are connected. In other aspects, the first and second frame members are not connected. In further aspects, at least one end of the first and second frame members are connected to the upper or the sole, or a combination thereof. In yet further aspects, both ends of the first and second frame members can be connected to different portions of the sole.

In further aspects, the first frame member can comprise a ball frame member. In still further aspects, the second frame member can comprise a heel frame member. In yet further aspects, the ball member and heel member can be connected by at least one third frame member. In even further aspects, at least one end of the ball member and at least one end of the heel member may be connected by a third frame member. In still further aspects, two ends of the ball member and two ends of the heel member may be connected by a third frame member.

In further aspects, the support frame can comprise a first frame member, a second frame member, and a third frame member. In still further aspects, at least a portion of each member can be connected to another member, the upper, or the sole, or a combination thereof. In yet further aspects, at least a portion of the first and third frame members can be connected to the second frame member, upper or the sole, or a combination thereof. In even further aspects, at least one end of the first and third frame members can be connected the upper or the sole, or a combination thereof. In still further aspects, a middle portion of the frame members can be connected to a portion of other frame members. In some aspects, a middle portion of the first and third frame members can be connected to a portion of the second frame member. In other aspects, the third member may comprise a sole frame member.

In further aspects, at least a portion of the second frame member can be connected to the first frame member, third frame member, upper, or sole, or a combination thereof. In still further aspects, at least one end of the second frame member is connected to the first frame member, third frame member, upper, or sole, or a combination thereof. In even further aspects, a middle portion of the second frame member can be connected to the first or third frame members, or a combination thereof. In some aspects, a first end of the second frame member can be connected to a first end of first frame member and a second end of the second frame member can be connected to a first end of the third frame member. In other aspects, a first end of the second frame member can be connected to a first end of first frame member and a second end of the second frame member can be connected to a first end of the third frame member. In further aspects, the second end of first frame member can be connected to a first portion of the sole and a second end of the third frame member can be connected to a second portion of the sole.

In various aspects, at least a portion of the frame members can have an arcuate shape. In further aspects, a middle portion of the frame members can have an arcuate shape. In still further aspects, the first frame member, the second frame member, or the third frame member can have an arcuate shape. In even further aspects, at least a portion of the first frame member, and the second frame member can have an arcuate shape, such as, for example, a semi-circle, or the like. In yet further aspects, the ball frame member can have an arcuate shape. In some aspects, the heel frame member has an arcuate shape.

In some aspects, a portion of the frame members may extend outward a predetermined direction at a predetermined angle from their connection or attachment point. In some aspects, a portion of the frame members may extend outward a predetermined direction at a predetermined angle from their connection or attachment point. In further aspects, the portion of the frame members can each extend away from the remaining portion of the frame member at an angle in the range of from about 15 degrees to about 120 degrees. In still further aspects, a portion of the first and second ends of the frame members can each extend outward a predetermined direction at a predetermined angle. In yet further aspects, a portion of the first and second ends of the second frame member each extend outward a predetermined direction at a predetermined angle. In some aspects, a portion of first and second ends of the second frame member can each extend away from the remaining portion of the member at an angle in the range of from about 15 degrees to about 120 degrees.

In further aspects, the shoe or shock-absorbing assembly can further comprise a heel support frame having at least one shock-absorbing member connected to a portion of the heel support frame. In still further aspects, the heel support frame can be connected to at least a portion of the support frame, rear upper or rear sole, or a combination thereof. In some aspects, the heel support frame can be connected to an outer surface of the upper. In other aspects, the heel support frame can be connected to an inner surface of the upper. In yet other aspects, the heel support frame can be integrally connected between an outer surface and inner surface of the upper.

In further aspects, the support frame can be connected to an outer surface of the upper. In still further aspects, the support frame can be connected to an inner surface of the upper. In yet further aspects, the support frame can be integrally connected between an outer surface and inner surface of the upper. In even further aspects, the support frame can be connected to an outer surface of the sole. In still further aspects, the support frame can be connected to an inner surface of the sole. In yet further aspects, the support frame can be integrally connected between an outer surface and inner surface of the sole.

In various aspects, the support frame further comprise a plurality of apertures configured to receive a shoelace. In further aspects, at least a portion of the support frame can be positioned on the upper in a location corresponding to a lacing portion of the upper. In still further aspects, the support frame can be configured to form an opening or lacing gap on the upper. In some aspects, the shoe can further comprise a tongue configured and sized to fill the lacing gap. In other aspects, the tongue may be larger than those found in traditional shoes depending on the frame identified. For example, for the shock-absorbing member positioning on the sides of the upper, the lacing gap can be bigger and hence a larger tongue might be necessary. The tongue can be made from any suitable material, such as, for example, breathable high-density foam materials for comfort and support.

In various aspects, the component arrangement and construction of the shock-absorbing assembly can be configured to correspond to areas of a user's foot where impact forces are greatest. In further aspects, the support frame can be connected to portions of the upper corresponding to the ball of the foot and/or or heel of the foot. In still further aspects, the plurality of shock-absorbing members may be configured in a stable arrangement such than the shock-absorbing member can stay vertical or at a predetermined angle when loads are applied to the shock-absorbing member. In even further aspects, the plurality of shock-absorbing members may comprise at least three shock-absorbing members, for example, four or five shock-absorbing members, or more. In yet further aspects, the plurality of shock-absorbing members can be each connected to a portion of the support frame. In still further aspects, the plurality of shock-absorbing members can each be connected by a first end of the shock-absorbing members. In yet further aspects, the plurality of shock-absorbing members can each extend away from the connection or attachment point. In even further aspects, at least one shock-absorbing member can be connected to the support frame at a location corresponding to an upper portion of the upper. In still further aspects, at least one shock-absorbing member can be connected to the support frame at an upper portion of the upper adjacent to a location corresponding to a ball of a wearer's foot. In yet further aspects, at least two shock-absorbing members can be connected to the support frame at an upper portion of the upper adjacent to a location corresponding to a ball of a wearer's foot. In some aspects, the at least two shock-absorbing members can be connected on opposite sides of the upper.

In further aspects, at least one shock-absorbing member can be connected to a rear portion of the upper. In still further aspects, at least one shock-absorbing member can be connected to a heel support frame at a rear portion of the upper adjacent to a location corresponding to a heel of a wearer's foot. In some aspects, a plurality of shock-absorbing member can be connected to a heel support frame. In other aspects, at least two shock-absorbing members can be connected to the support frame at an upper portion of the upper adjacent to a location corresponding to a ball of a wearer's foot; and at least one shock-absorbing member can be connected to a heel support frame at a rear portion of the upper adjacent to a location corresponding to a heel of a wearer's foot. In other aspects, a plurality of shock-absorbing members can be connected to the support frame at an upper portion of the upper adjacent to the heel of the wearer's foot.

In various aspects, the rotational position of the shock absorbing member can be configured or changed with respect to the upper and sole to permit changes to the impact-attenuation characteristics of the article of footwear or other foot-receiving devices. For example, the shock-absorbing members can be located one on each side near the ball of the feet and one on each side at the heel position, such as, positions that primarily come into play or are associated with walking strides and/or are responsible for propulsion.

In further aspects, the shock-absorbing members can comprise a plurality of connection points for attaching to the shoe. In still further aspects, the shock-absorbing assembly can comprise a first, second, and third shock-absorbing member.

In further aspects, the shock-absorbing members may extend from a portion of the upper or support frame (e.g., an attachment or connection point) beyond an outermost surface of the sole. In still further aspects, the second ends of shock-absorbing members can extend a predetermined distance beyond an outermost surface of the sole. In yet further aspects, the predetermined distance can be from about 1 cm to about 20 cm. In still further aspects, the predetermined distance may be determined based on a number of variables, such as, for example, the desired amount of shock-absorption or the configuration of the shock-absorbing assembly.

second ends of shock-absorbing members can be connected using a bridge, such as an elongated member.

In further aspects, the shock-absorbing member can comprise at least one foot, leg or body member, a combination thereof. In still further aspects, the shock-absorbing member can comprise an impact-dampening component configured to attenuate a force. In yet further aspects, the shock-absorbing member can be configured to have any desired level of impact attenuation. For example, according to some aspects, the level of impact attenuation can comprise from about 10% to about 90% or more attenuation of ground reaction forces applied on the wearer's feet with each stride.

In various aspects, the shock-absorbing members can utilize the mechanical properties and benefits of the impact-dampening component (compression spring, wave spring or the like) for shock absorption. In further aspects, the impact-dampening component can be a compression spring, shock, compressible foam, columnar and telescoping structure, a biasing system, air or gas filled compression mechanism, gel or liquid filled compression mechanism, and/or other components made out of suitable materials that can be manufactured for a weight range. In still further aspects, the impact-dampening component can comprise other shock absorbing materials, such as, for example, gels, air, gas, hydraulic, foam, a combination thereof or the like. In some aspects, the body member can be a cylindrical tube or a semi cylindrical tube or any of the like enclosed chamber capable of and configured to hold the impact-dampening component. In other aspects, the body member can be an open chamber capable of and configured to hold the impact-dampening component.

In various aspects, the shock-absorbing member can have an extended position and a compressed position. For example, the shock-absorbing members can be configured to compress or flatten out to a compressed position from an extended position under an impact force applied to a base or end portion (e.g., from taking a step or walking). In further aspects, the shock absorbing members can be configured to return back to an extended position or toward its original size, shape, and orientation once the impact force is removed or relieved. In some aspects, the leg or body members can be configured to compress or flatten out to a compressed position under an impact force applied to a base or foot portion (e.g., from taking a step or walking, as described above).

Since the shock-absorbing members may contact the ground, the second end of the shock-absorbing members can comprise a surface-contacting portion configured to contact the ground, such as, for example, a shoe-sole like bottom used for traction. In some aspects, the surface-contacting portion can be configured or angled to maximize surface area contact with a surface when the shoe is moved toward the surface.

In further aspects, the foot can be a structure that contacts the ground or any other surface. In still further aspects, the foot can comprise a gripping portion. In yet further aspects, the gripping portion can be pivotally connected. In even further aspects, the gripping portion can comprise a compressible material. In some aspects, the gripping portion can be substantially flat. In other aspects, the gripping portion can be curved or angled.

In further aspects, the shock-absorbing member may further comprise a roller component connected to a portion of the shock-absorbing member. For example, the surface-contacting portion or foot of the shock-absorbing member may comprise a roller component. In yet further aspects, the roller component may be configured to rotate about an axis, for example, to propel a wearer forward. In even further aspects, the roller component may be configured to be detachably connected to the shock-absorbing member. In still further aspects, the roller component may comprise a wheel, such as, for example, a roller skate wheel.

In further aspects, the shock-absorbing member and/or foot can be comprised of suitable and conventional materials configured to provide long wear, traction, and protect the foot and/or to prevent the remainder of the footwear or foot-receiving device structure from impacts effects when contacting the ground or other surface in use. In still further aspects, the shock-absorbing members can have a load capacity lesser than the weight of the individual, for example, such that a user's foot touches the ground during every stride. Since some contacting of the ground is needed to achieve propulsion, the user's weight can be utilized to calculate a desired load capacity for each shock-absorbing member. By weigh of non-limiting example, the combined load capacity of the shock-absorbing member can vary from about 1 times to about 5 times the body weight of a user. To this end, the load capacity can be configured to different applications ranging from walking to running and other higher intensity activities.

In further aspects, the shock-absorbing member characteristics, such as, for example, size and dimensions, can be configured to adjust for an individual user's weight, feet size, and other factors to achieve optimal load balancing and distribution. In further aspects, features of the shock-absorbing member may be configured or utilized to set and/or control the impact-attenuation characteristics of the member. For example, at least one of the following may be configured: the type of material used for the shock-absorbing member; the shock-absorbing member dimensions (e.g., height, width, thickness, leg width, length, thickness, curvature, etc.; surface-contacting portion thickness, width, etc.); the flexibility or "stretchiness" of the material; the elastic characteristics of the material; the degree of tension on the material under neutral conditions; the percentage of open space (if any) in any portion; and the extent of exterior surface coverage of surface-contacting portion.

In further aspects, the shock-absorbing member may have an overall length of from about 1 inch to about 5 inches, including exemplary lengths of about 1.5, 2.0, 2.5, 3.0, 3.5, 4.0, and 4.5 inches. In still further aspects, the shock-absorbing member may have a diameter of from about 0.5 inch to about 2.5 inches, including exemplary diameters of about 1.0, 1.5, and 2.0 inches. In yet further aspects, the impact-dampening component, for example, a spring, may have a length of from about 1 inch to about 5 inches, including exemplary lengths of about 1.5, 2.0, 2.5, 3.0, 3.5, 4.0, and 4.5 inches. In even further aspects, the impact-dampening component may have a mean diameter of from about 0.5 inch to about 2.5 inches, including exemplary diameters of about 1.0, 1.5, and 2.0 inches.

In further aspects, the impact-dampening component may have a wire diameter of from about 0.05 inch to about 1.0 inches, including exemplary wire diameters of about 0.1, 0.15, 0.2, 0.25, 0.3, 0.4, 0.5, 0.6, 0.7, 0.8, and 0.9 inches. In still further aspects, the impact-dampening component may comprise a pitch (i.e., space between coil turns) of from about 0.05 inch to about 1.0 inches, including pitch values of about 0.1, 0.15, 0.2, 0.25, 0.3, 0.4, 0.5, 0.6, 0.7, 0.8, and 0.9 inches. In yet further aspects, the impact-dampening component may have a spring rate (i.e., load required to compress 1-inch) from about 20 pounds to about 300 pounds, including exemplary spring rates of about 20, 30, 40, 50, 60, 70, 80, 90, 100, 110, 120, 130, 140, 150, 160, 170, 180, 190, 200, 210, 220, 230, 240, 250, 260, 270, 280, and 290 pounds.

In further aspects, the spring rate can be calculated for a desired compression, where the rate=Applied Weight×Desired compression. By way of non-limiting example, with a weight distribution between ball and heel (i.e., 90-30), and by knowing the number of springs at the corresponding location, the weight bearing requirements at each spring location can be determined. In still further aspects, spring rate may be determined based on spring's dimensions, where rate=(d^4G)/(8(D^3)N) where D is the mean diameter; d is the wire diameter; N is the total number of coils; and G is the torsion modulus of the material. In yet further aspects, both of the foregoing methods can be used to determine a configuration and/or construction of shock-absorbing members that closely match the wearer's weight. In various aspects, the benefits can be realized to all users regardless of their weight.

In further aspects, while the shock-absorbing assembly described herein can be permanently mounted in or on a footwear or other foot-receiving device structure, this is not a requirement. For example, a shock-absorbing assembly can be removably mounted in or on footwear or other foot-receiving device structure, e.g., to allow interchange and/or replacement of the shock-absorbing assembly. Thus, according to further aspects, the present disclosure also provides a shock-absorbing assembly for an article of footwear, the shock-absorbing assembly comprising: at least one support frame configured to connect to at least a portion of the article of footwear, and a plurality of shock-absorbing members having first and second opposed ends, the first ends of the shock-absorbing members being connected to a portion of the support frame.

In further aspects, one or more shock-absorbing members can be detachably connected to the support frame and/or footwear, e.g., to allow interchange and/or replacement of one or more shock-absorbing members (individually or as a unit with multiple impact-attenuating members in a shock-absorbing assembly). Such configurations allow users, purchasers, retailers, or others to select desired impact-attenuating properties or levels in a footwear structure, e.g., for customization purposes, for personal preferences, to match desired use or a user's physical characteristics or to repair or replace defective or damaged shock-absorbing members, etc.

In further aspects, the support frame can comprise a wide variety of relatively stiff, but pliable materials, such as plastic steel, aluminum, or metal alloys, or a combination thereof. In still further aspects, the support frame can be comprised of metal, thermoplastic resin, ceramic, rigid plastic material, reinforced plastic or composite materials, polyethylene, polypropylene, wood (plywood, bamboo, or the like), magnesium, carbon fiber, high density rigid foam, Kevlar® or the like strong flexible textile materials, or a combination thereof.

In further aspects, the upper can be comprised of fabric, cloth, plastic, woven or non-woven, natural or synthetic, leather, polyurethane, microfiber leather, faux leather and PU leather, Nylon, cotton or the like. In some aspects, the upper can be comprised of a blend of synthetic and breathable cotton materials which also have the shoe frame stitched along with appropriate cushioning materials for providing good comfort.

In further aspects, the sole can be comprised of any suitable material, such as, for example, rubber, high density cushioning foam, foam and fabric, or other material adapted for ground impact. In some aspects, the sole may comprise a tread pattern to provide traction. In other aspects, the sole may contain a flat bottom and in other aspects it may have designed groove patterns to minimize the use of materials to only the essential areas.

In various aspects, the components of the disclosed devices and footwear can be detachably attached. In further aspects, the components can be connected by a connecting means. In still further aspects, the connecting means can comprise a fitting, insert, adhesive, brazing, soldering, welding, spot weld, screw with nut, rivet, threading, friction fit, snap-fit, twist-lock, or interlocking mechanism or a combination thereof. In yet further aspects, the connection can be achieved using a snap, friction fitting, snap ring, O-ring, pressure fitting, clip, clasp, and the like. The snap ring or O-ring can be retained within a groove to accommodate the snap ring or O-ring. In a further aspect, the system can comprise an engagement means for coupling and holding components together. In a further aspect, the engagement means can be a screwing mechanism, a click-lock mechanism, or friction mechanism, or the like.

In a still further aspect, the components can be integrally or mechanically attached to other components. In a yet further aspect, the disclosed components can be connected, attached, or mounted using a connecting means, the connecting means comprising a fitting, insert, adhesive, brazing, soldering, welding, spot weld, screw with nut, rivet, fitting, insert, threading, friction fit, or snap-fit or a combination thereof.

In one aspect, disclosed herein is a shock-absorbing shoe may comprising: an upper; a sole; and a shock-absorbing assembly, the shock-absorbing assembly comprising: a support frame connected to at least a portion of the upper or sole, and a plurality of shock-absorbing members having first and second opposed ends, the first ends of the shock-absorbing members being connected to a portion of the support frame; wherein the support frame comprises a first frame member, a second frame member, and a third frame member, wherein at least a portion of each member is connected to another member, the upper, and the sole. In further aspects, one end of the first and third frame members are connected to the upper and the sole, and a middle portion of the first and third frame members are connected to a portion of the second frame member; and a portion of the first frame member, the second frame member, and the third frame member have an arcuate shape, and a portion of the first and second ends of the second frame member each extend away from the top of the shoe at an approximately 90-degree angle. In still further aspect, there is a heel support frame having at least one shock-absorbing member connected to a portion of the heel support frame; and the heel support frame is connected to at least a portion of the rear upper. In even further aspect, the support frame further comprises a plurality of apertures configured to receive a shoelace, and a portion of the support frame is positioned on the upper in a location corresponding to a lacing portion of the upper.

In further aspects, two shock-absorbing members may be connected to the support frame at an upper portion of the upper, adjacent to a location corresponding to a ball of a wearer's foot; and one or more shock-absorbing member is connected to a heel support frame at a rear portion of the upper, or at the sides. adjacent to a location corresponding to a heel of a wearer's foot; and the second end of the shock-absorbing members comprise a surface-contacting portion configured to contact the ground, and are angled to maximize stability and surface area contact with a surface when the shoe is moved toward the ground. In still further aspects, the shock-absorbing members extend down from the upper beyond an outermost surface of the sole, and comprise an impact-dampening component configured to attenuate the applied force experience when taking a step.

Also disclosed herein are methods of using the disclosed shock-absorbing shoes and devices. For example, in another exemplary aspect, the present disclosure provides a method for dampening an applied force to a joint during walking; the method comprising: providing an article of footwear having a shock-absorbing assembly, the shock-absorbing assembly comprising: a support frame configured to connect to at least a portion of the article of footwear, and a plurality of shock-absorbing members having first and second opposed ends, the first ends of the shock-absorbing members being connected to a portion of the support frame. In further aspects, the method can further comprise walking using the article of footwear or shock-absorbing shoe. In still further aspects, the method can reduce ground reaction forces on feet by reducing the duration of direct contact between feet and ground.

In further aspects, the method may comprise using the shock-absorbing members as the first points of contact before the sole touches the ground. In still further aspects, the may comprise reducing the effective load the feet endure through the sole. In yet further aspects, the shock-absorbing members may not be connected at the bottom of the shoe, and wherein any residual force being applied after full compression to the upper portion of the shoe frame structure may be used to help in lifting the feet up.

Also disclosed herein is the presumed functionality of the disclosed shock-absorbing shoes and devices. As per Newton's third law: every action has equal and opposite reaction. When a certain amount of weight X acts on a rigid surface such as earth, concrete etc., the applied weight is transferred from the applying body to the stable surface and instantaneously the immovable object gives all the applied force back to the applying body (for example, a ball coming back after colliding with a wall). These forces given back from the ground while walking or running or the like are named as ground reaction forces (GRF) and these forces travel back into the human skeletal structure. The GRF travel through the rigid bones and will be minimized in part at the joints primarily due to the natural cushioning tissues that reside in joints such as knees, hips, and the like. Depending on the speed of walking or running, duration of walking or running and the amount of weight acting on each foot (among other factors), these forces can even reach up to the lower lumbar structure. Prolonged endurance of impact forces by joints and lower back leads to damaging the tissues and results in knee, hip or back pain. Having a plurality of shock-absorbers mounted external to the device of a footwear at stable locations has the advantage of diverting the ground reaction forces outside the wearer's feet and footwear devices disconnecting and eliminating the possibility of the ground reaction forces travelling back to the wearer's skeletal structure. Also, utilizing the shoe upper structure as one of the connected ends to the shock-absorber assembly will utilize the force of compressing the shock-absorbers to pull the feet up and helping the wearing lift the feet with ease and lesser effort.

Without wishing to be bound by a particular theory, the combination of inventive support frame configurations and shock-absorbing member positioning outside of the sole allow the disclosed shock-absorbing shoes and devices to be more effective in reducing impact and forces to a wearer's joints and body during walking, for example, by acting as the first points of contact before the feet touch the ground. Moreover, the disclosed shock-absorbing shoes and devices are able to reduce the effective load the feet endure with each stride since the mechanism is not connected at the bottom of the shoe, and transfer any residual force being applied after full compression to the upper portion of the shoe frame structure which can use these forces to help in lifting the feet up. In further aspects, as the user's weight keeps acting from top, the compression capability of the shock absorber is used first before the remainder of the load is left to act on the feet itself, and thus, a calculated load capacity can be used to configure the shock-absorbing members. For example, insufficient load capacity can compress too quickly and a high load capacity may not achieve sufficient compression for given user's weight. Following compression, the shock-absorbing member can transfer the force and push into the support frame. The transferred force and energy to the support frame can assist in pulling the support frame, which can be attached to the sole or upper, up, thereby, assisting in lifting the user's foot.

According to various aspects of the invention, the shock-absorbing shoes and devices of the present disclosure can comprise multiple configurations. For example, various exemplary embodiments of the inventive shock-absorbing shoes and devices are shown in FIGS. 1-11.

In one aspect, FIG. 1 shows an exemplary embodiment of a shock-absorbing shoe 100 in accordance with the present invention. As shown, the shoe comprises an upper 102; a sole 104; and a shock-absorbing assembly 106, the shock-absorbing assembly 106 comprising: a support frame 108 and a plurality of shock-absorbing members 110 having first and second opposed ends. The support frame 108 is shown connected to a portion of the upper 102 and a portion of the sole 102 and the first ends of the shock-absorbing members are shown connected to portions of the support frame 108.

Here, the support frame 108 has a one-piece construction with a ball portion 112 and a heel portion 114. The ball portion 112 of the support frame 108 is arcuate shaped, and is configured to be disposed over a top portion of a wearer's foot. The ball portion 112 of the support frame 108 is connected to a top portion of the upper, and tapers down following the natural shape of the foot. The ball portion 114 of the support frame 108 is semi-circle shaped to be disposed around of the heel of a wearer's foot, and is connected to a back portion of the upper. Both the ball and heel portions also can have attachment point at the sole. While this embodiment shows an integral construction, the ball portion 114 and the ball portion 112 could comprise distinct frame members, and be connected using a frame member.

In another aspect, FIGS. 2A-2E show various views of another exemplary embodiment of a shock-absorbing shoe 200 in accordance with the present invention. As shown, this shoe also comprises an upper 202; a sole 204; and a shock-absorbing assembly 206, however, this shock-absorbing assembly 206 comprises a ball support frame 212 and a heel support frame 214, each support frame having a plurality of shock-absorbing members 210. The ball support frame 212 is shown connected to a front portion of the upper 202 and a front portion sole 204, corresponding to the area around the ball of the foot; and the heel support frame 214 is shown connected to a rear portion of the upper 202 and a rear portion of the sole 204 corresponding to the area around the heel of the foot. The heel support frame 214 and the ball support frame 212 are both connected to the upper 202 and sole 204, but in this embodiment, the heel support frame 214 and the ball support frame 212 are connected using a frame member 208, traveling along a substantially similar plane as the sole 204.

Figure 3A:
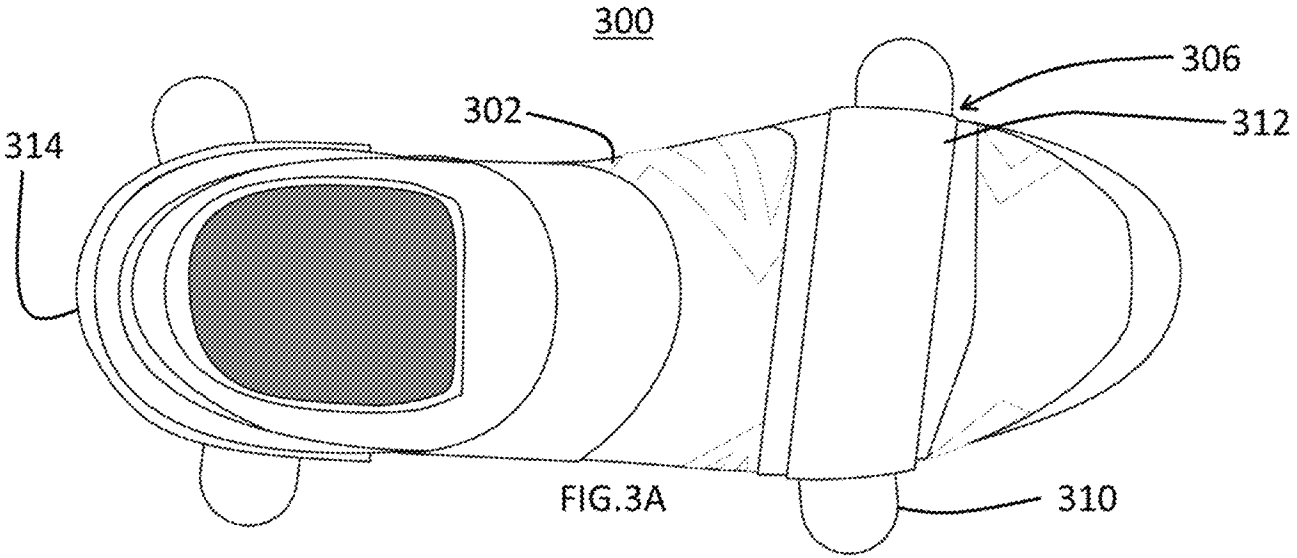
FIGS. 3A-3B show various views depicting of a shock-absorbing member of the shock-absorbing assembly in accordance with another exemplary embodiment of the present invention.
Figure 3B:
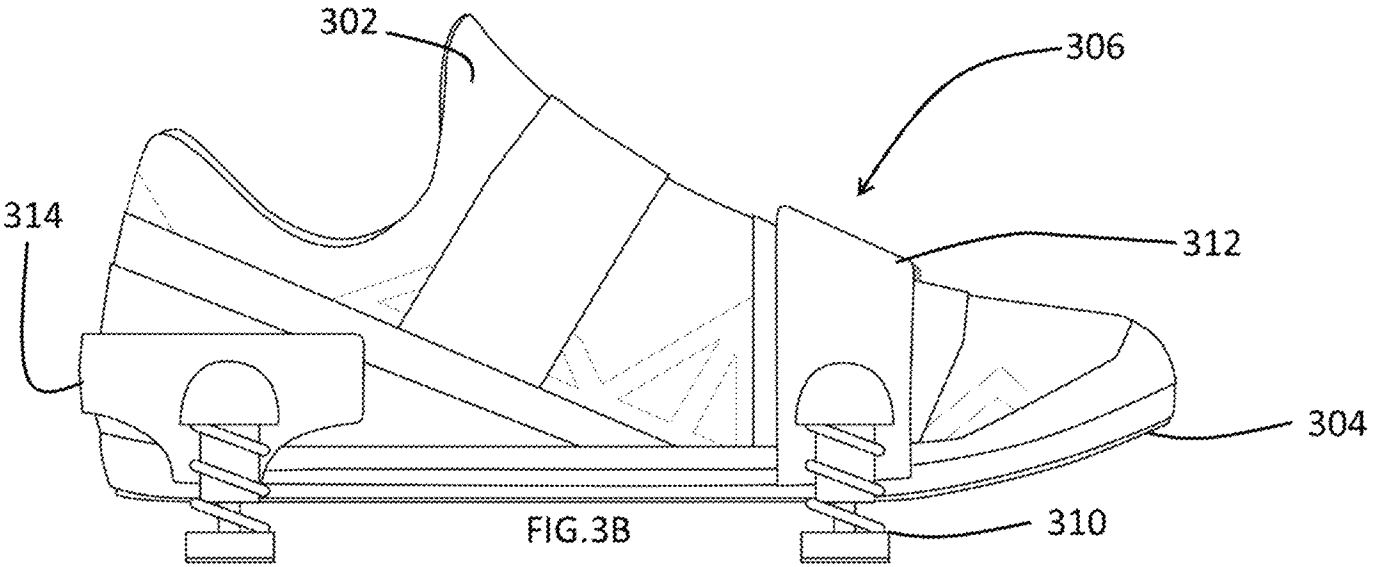
Figure 4A:
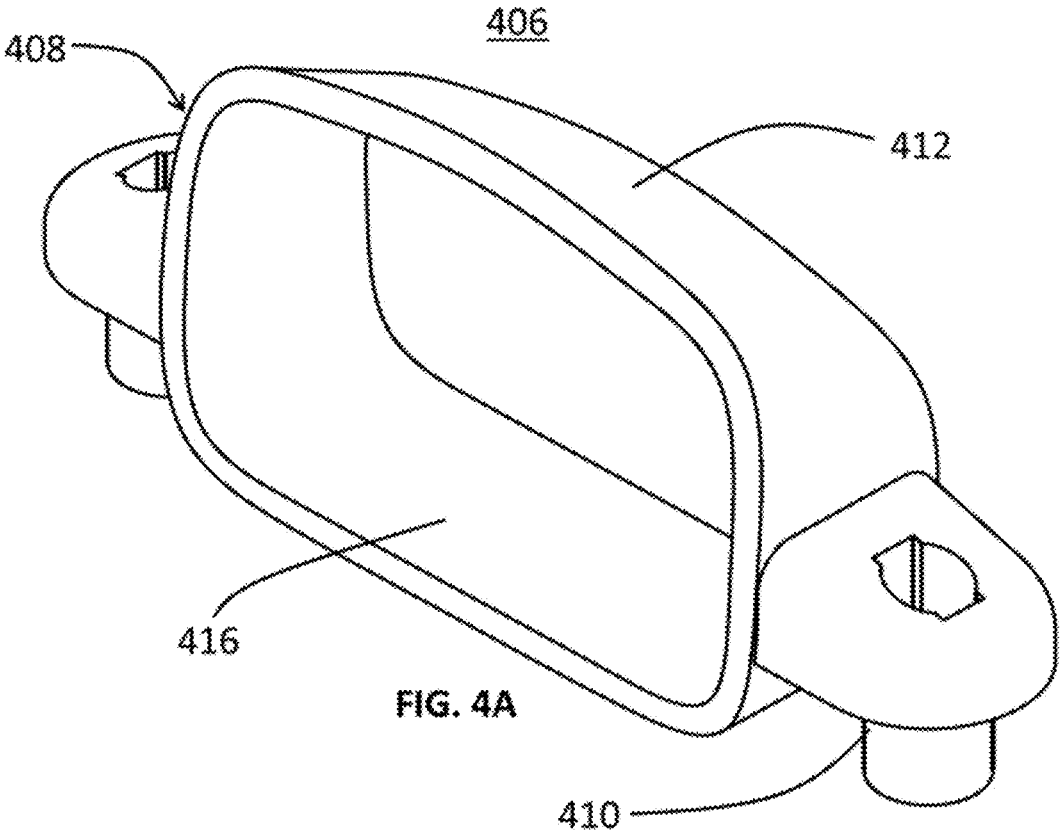
FIGS. 4A-4B show various views depicting a shock-absorbing assembly for use with footwear in accordance with another exemplary embodiment of the present invention.
Figure 4B:
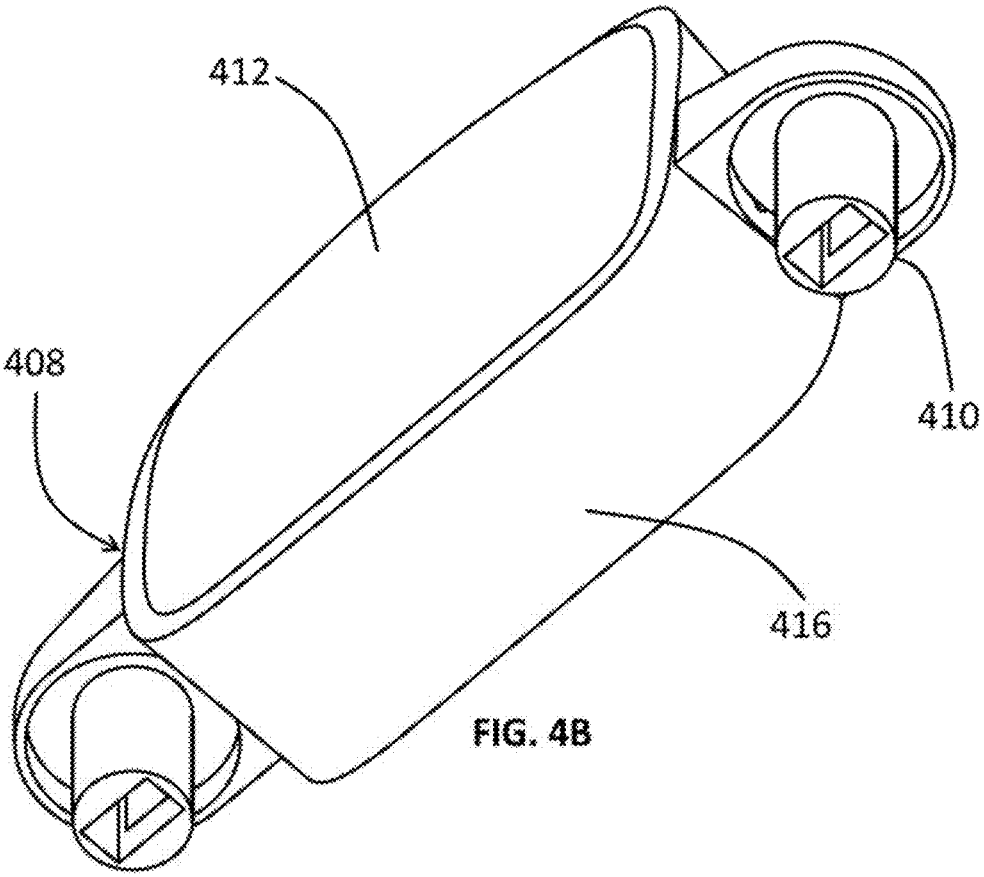
Figure 5A:
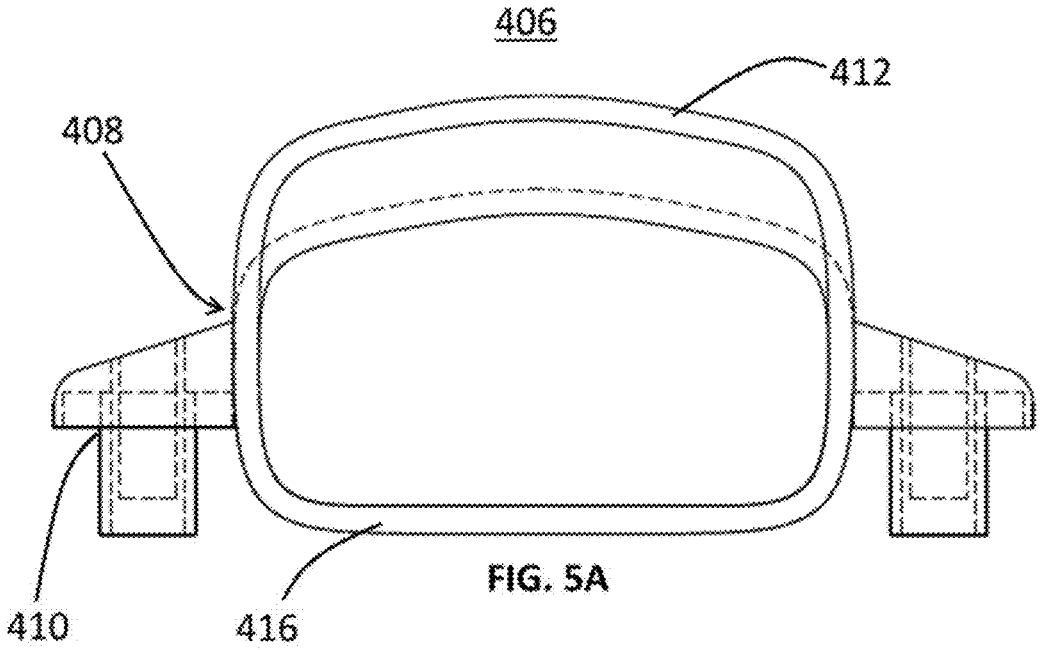
FIGS. 5A-5C show various views depicting a shock-absorbing assembly for use with footwear in accordance with another exemplary embodiment of the present invention.
Figure 5B:
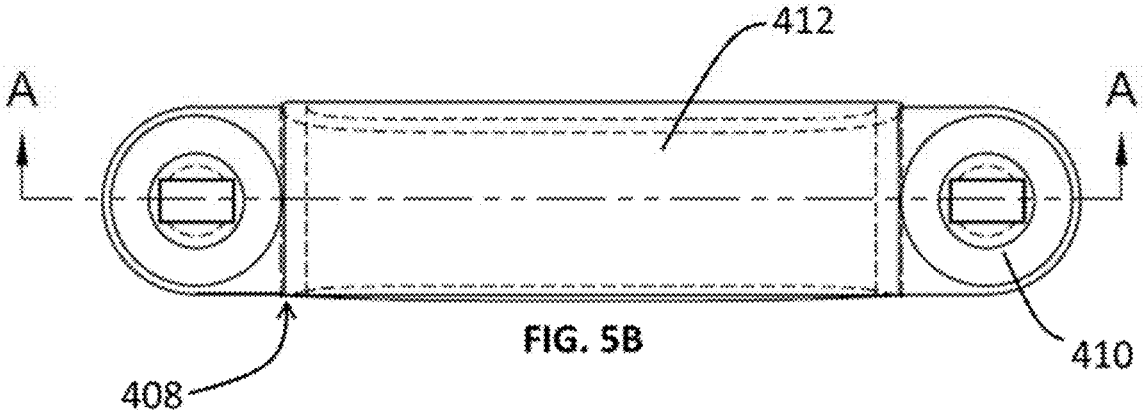
Figure 5C:
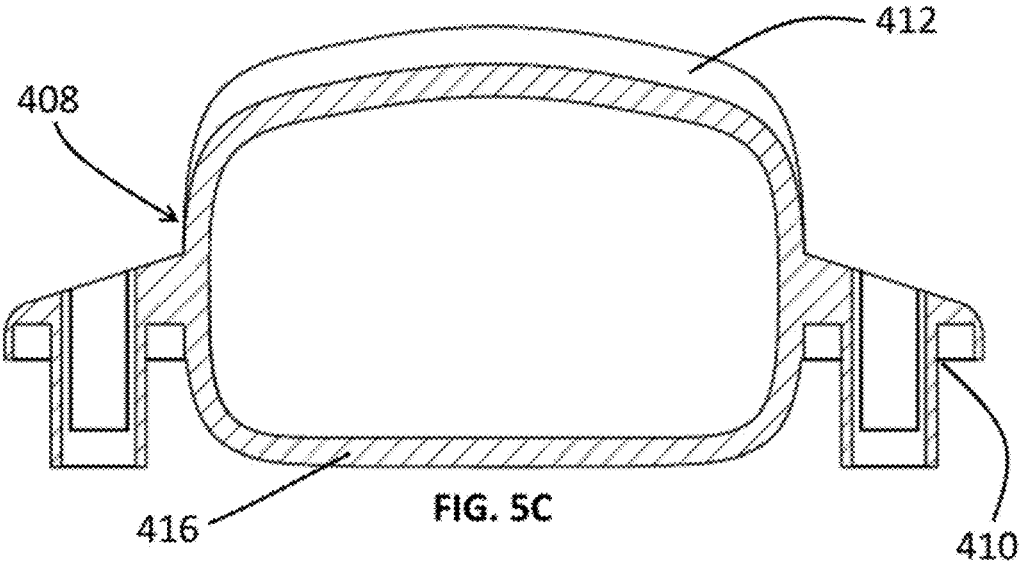
Figure 6A:
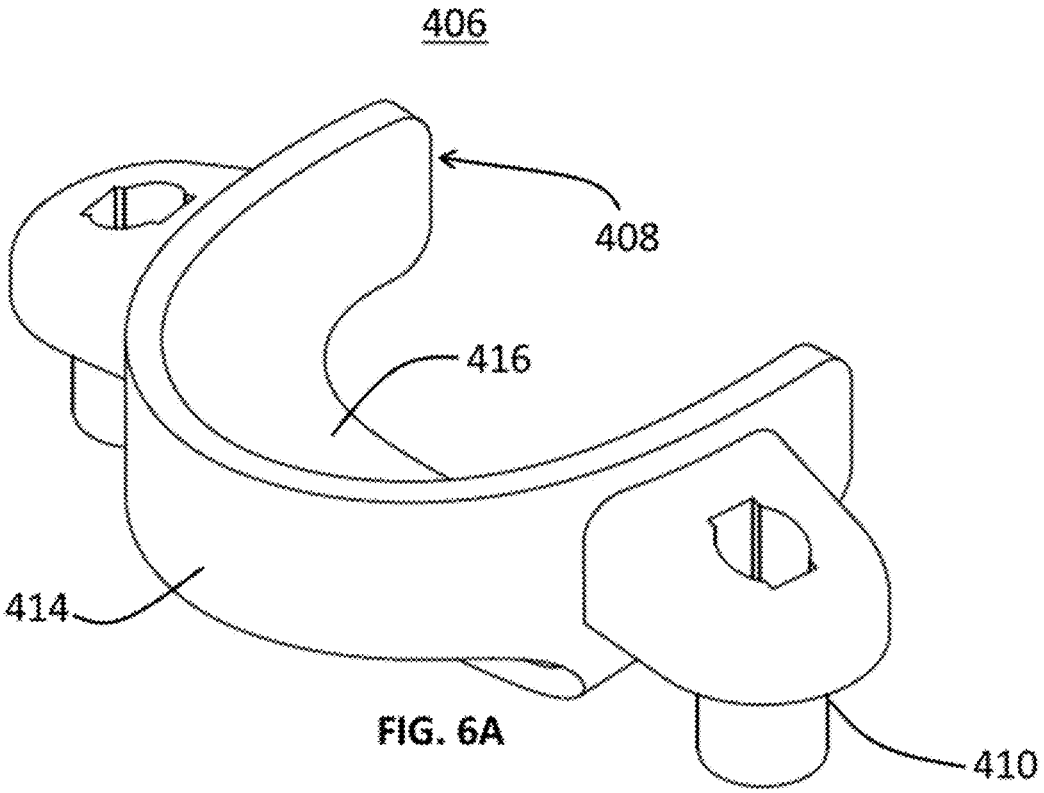
FIGS. 6A-6B show various views depicting a shock-absorbing assembly for use with footwear in accordance with another exemplary embodiment of the present invention.
Figure 6B:
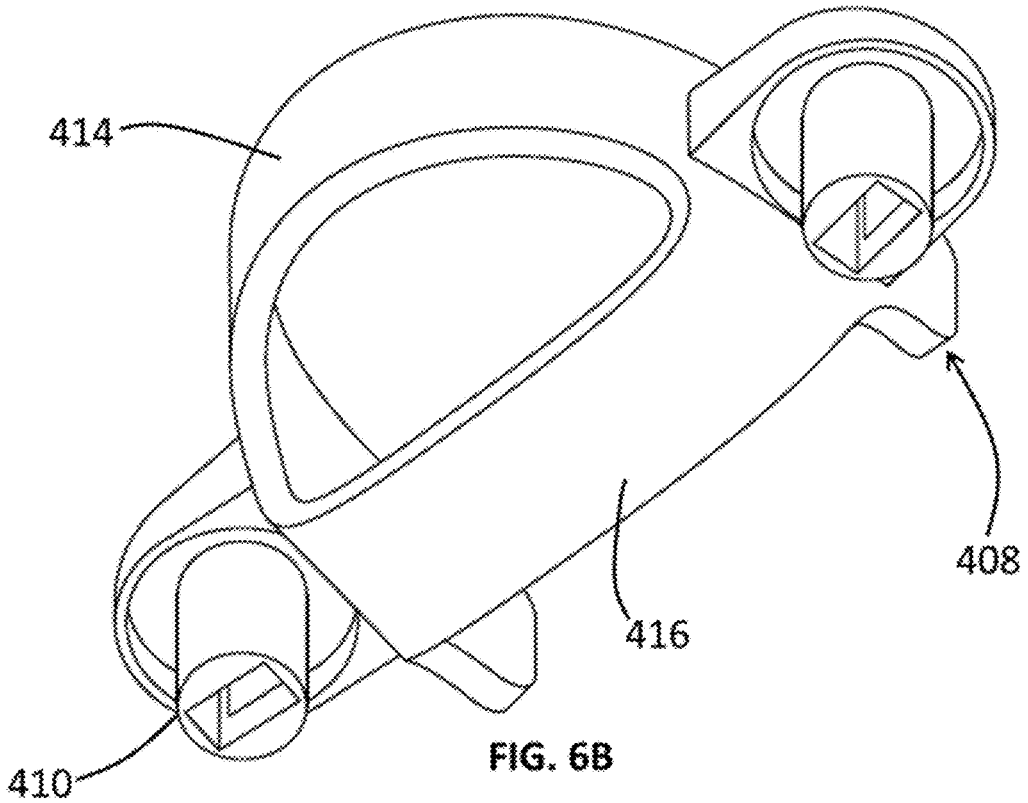
Figure 7A:
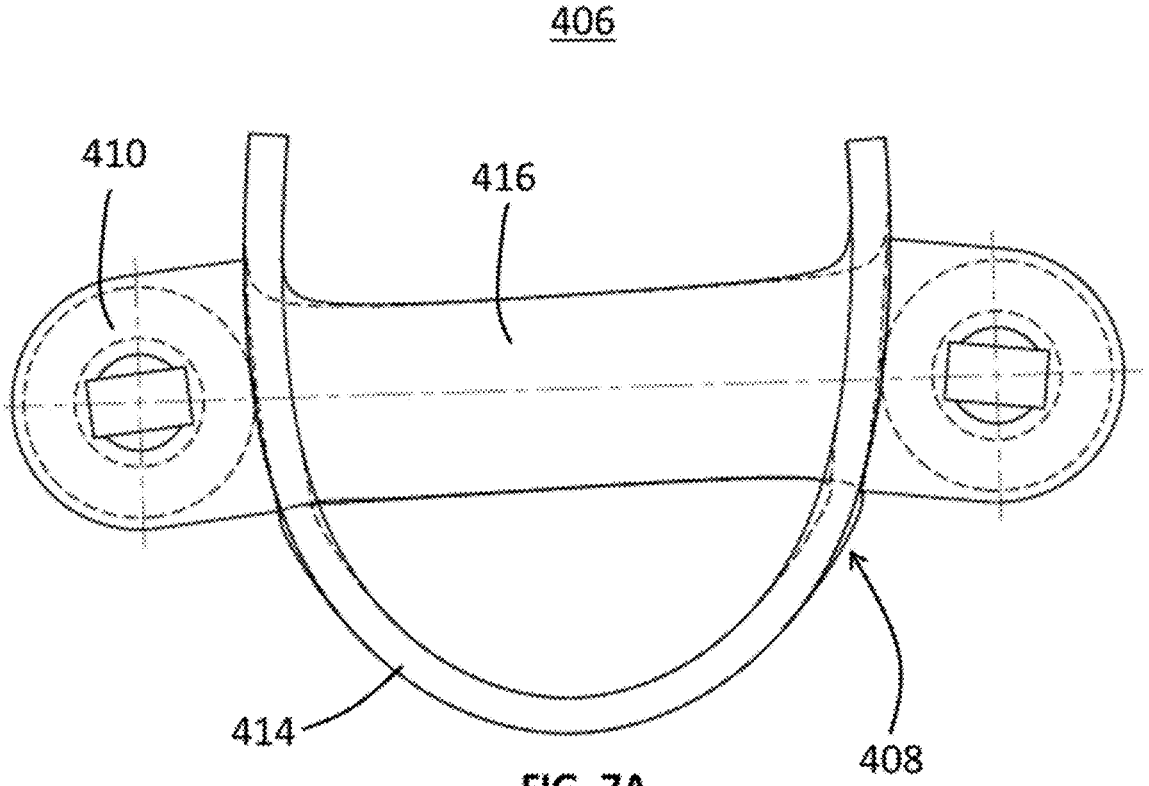
FIGS. 7A-7B show various views depicting a shock-absorbing assembly for use with footwear in accordance with another exemplary embodiment of the present invention.
Figure 7B:
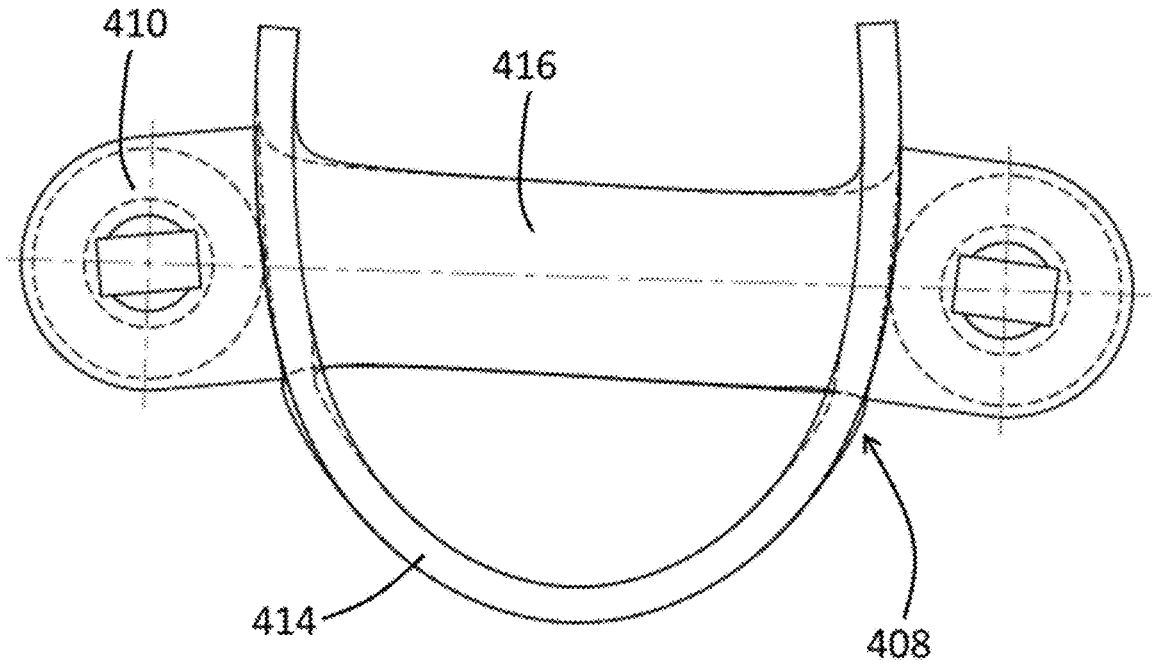

In another aspect, FIGS. 3A-3B show various views of another exemplary embodiment of a shock-absorbing shoe 300 in accordance with the present invention. As shown, this shoe also comprises an upper 302; a sole 304; and a shock-absorbing assembly 306 comprising a ball support frame 312 with a first frame member and a heel support frame 314 with a second frame member, each support frame having a plurality of shock-absorbing members 310. The ball support frame 312 is connected to a front portion of the upper 302 and a front portion sole 304, corresponding to the area around the ball of the foot; and the heel support frame 314 is connected to a rear portion of the upper 302 and sole 304 corresponding to the area around the heel of the foot. The heel support frame 314 and the ball support frame 312 are both connected to the upper 302 and sole 304, but in this embodiment, the heel support frame 314 and the ball support frame 312 are not connected. In various embodiments, the support frame may further comprise a sole portion. For example, according to further aspects, either or both of the ball portion and the heel portion may further comprise a sole portion in the form of a sole frame member extending from one side of the shoe to another side of the shoe. In still further aspects, the sole frame member may be integrated within or between layers of the sole, and may be located in an area of the sole corresponding to the ball area and/or heel area of a wearer's foot.

As shown in FIGS. 1-3B, the shock-absorbing members extend down from their attachment points a predetermined distance past the outermost surface of the sole. The predetermined distance can be from about 1 cm to about 20 cm, and may be determined based on a number of variables, such as, for example, the desired amount of shock-absorption, the configuration of the shock-absorbing assembly, or construction of the shock-absorbing member. As shown in FIG. 2E, the shock-absorbing members are configured in a stable arrangement such than the shock-absorbing member can stay vertical or at a predetermined angle when loads are applied to the shock-absorbing member. As shown, two shock-absorbing members are connected to the support frame at a location corresponding to a ball of a wearer's foot on opposite sides of the upper, and two shock-absorbing members are connected at a location corresponding to a heel of a wearer's foot on opposite sides at a rear portion of the upper. To this end, the shock-absorbing members are located (such as one on each side near the ball of the feet and one on each side at the heel position), at positions that primarily come into play or are associated with walking strides and/or are responsible for propulsion.

While the shock-absorbing assemblies described in FIGS. 1-3A are shown to be permanently attached to or mounted in footwear, this is not a requirement. According to other embodiments, various shock-absorbing assemblies disclosed herein can be removably attached in or on footwear, e.g., to allow interchange and/or replacement of the shock-absorbing assembly. In further aspects, FIGS. 4A-9 show various embodiments of shock-absorbing assemblies for footwear comprising: at least one support frame configured to detachably connect to at least a portion of the article of footwear.

In one aspect, FIGS. 4A-5C show various views of an exemplary shock-absorbing assembly 406 for connecting to an article of footwear in accordance with the present invention. As shown, the shock-absorbing assembly 406 comprises a support frame 408 configured to connect to a front or ball portion of footwear, and two shock-absorbing members 410 having first and second opposed ends, the first ends of the shock-absorbing members 410 being connected to a portion of the support frame 408. This support frame 408 comprises a ball portion 412 configured to be disposed over a top portion of a foot, and tapers down following the natural shape of the foot; and a sole support portion 416 that may be configured to be disposed under (or inside) the sole of footwear. The ball and sole support portions 416 together form an opening to receive the front end of footwear. The tapered shaped opening (as shown in the FIGS. 5A and 5C) allows the support frame 408 to receive the foot, while positioning the support frame 408 at the appropriate location when installed on footwear.

In another aspect, FIGS. 6A-7B show various views of another exemplary shock-absorbing assembly 406 for connecting to an article of footwear in accordance with the present invention. As shown, the shock-absorbing assembly 406 comprises a support frame 408 configured to connect to a front or ball portion of footwear, and two shock-absorbing members 410 having first and second opposed ends, the first ends of the shock-absorbing members 410 being connected to a portion of the support frame 408.

This support frame 408 comprises a ball portion 414 that is semi-circle shaped, so to be disposed around of the back (or heel) of a wearer's foot, and a sole support portion 416 that can be configured to be disposed under (or within) the sole of footwear. The heel and sole support portions together form an opening to receive the back end of footwear, and can otherwise hold the heel in place within the frame.

Figure 8:
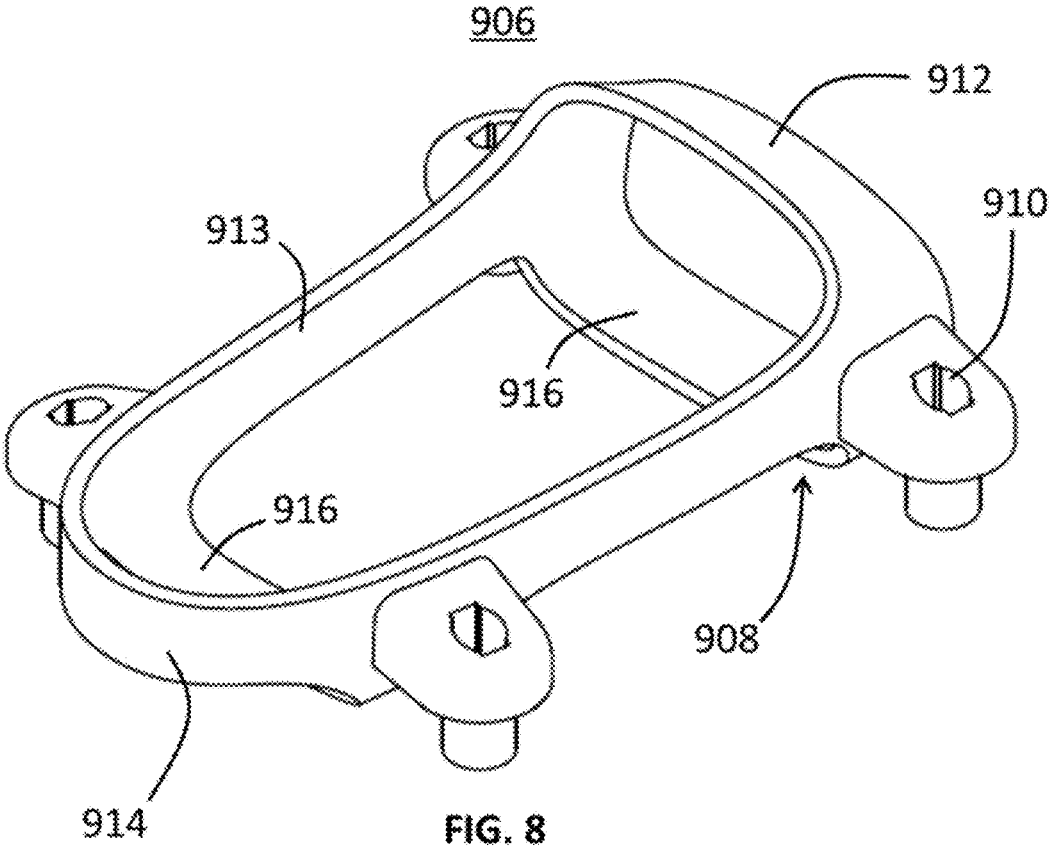
FIG. 8 shows a depiction of a shock-absorbing assembly for use with footwear in accordance with another exemplary embodiment of the present invention.
Figure 9:
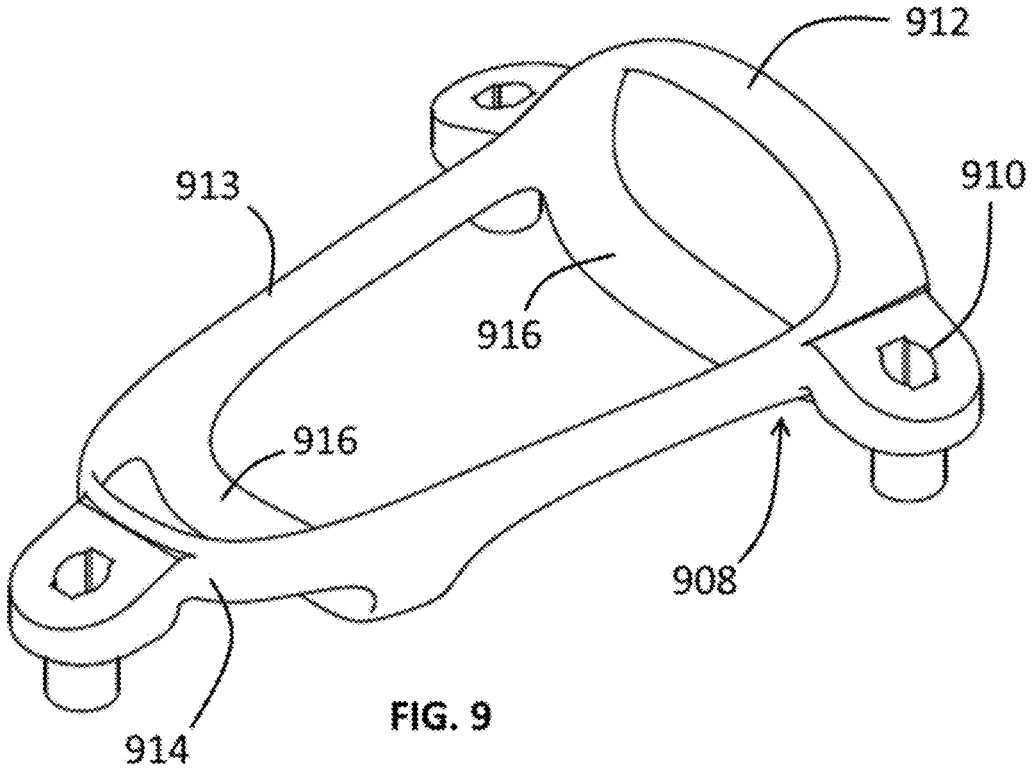
FIG. 9 shows a depiction of a shock-absorbing assembly for use with footwear in accordance with another exemplary embodiment of the present invention.

In various aspects, the previous two embodiments would be concurrently used in order to create a stable shock-absorbing arrangement. However, according to still further embodiments, FIGS. 8-9 provide embodiments of removable shock-absorbing assemblies 906 for footwear comprising one-piece or integral support frame 908 configured to detachably connect to the front and rear portion of the article of footwear, and thus, providing shock-absorbing properties to any footwear. In some embodiments, these shock-absorbing assemblies may be permanently attached to the upper, sole, or other portions of the shoe. In other embodiments, some or all portions of the shock-absorbing assemblies may be incorporated into portions of the upper or sole, for example, during manufacturing.

In one aspect, FIG. 8-9 shows exemplary embodiments of a shock-absorbing assembly 906 for connecting to an article of footwear, comprising a support frame 908 configured to connect to a front and heel portion of footwear, and three shock-absorbing members 910 having first and second opposed ends, the first ends of the shock-absorbing members 910 being connected to the front and heel areas of the support frame 908.

This support frame 908 comprises a ball portion 912 configured to be disposed over a top portion of a foot, and tapers down following the natural shape of the foot; a first sole support portion 916 that configured to be disposed under the sole of footwear. The ball and first sole support portions together form an opening to receive the footwear. This support frame 908 also comprises a ball portion 914 that is semi-circle shaped, so to be disposed around of the back (or heel) of a wearer's foot, and a second sole support portion 916 that is configured to be disposed under the sole of footwear. The heel and second sole support portions together form an opening to receive the back end of footwear, and can otherwise hold the heel in place within the frame. In various aspects, all or portions of a shock-absorbing assembly 906 may be integrated or incorporated within an article of footwear. For example, according to some embodiments, the sole support portions may be integrated or incorporated within the sole. In other embodiments, all or portions of the support frame 908 may also be integrated or incorporated within the upper.

In FIG. 8, two shock-absorbing members 910 are connected to the support frame 908 at a location corresponding to a ball of a wearer's foot on opposite sides of the upper; and one shock-absorbing member is connected to a heel support frame 908 at a rear portion of the upper adjacent to a location corresponding to a heel of a wearer's foot. In FIG.

9, two shock-absorbing members 910 are connected to the support frame 908 at a location corresponding to a ball of a wearer's foot on opposite sides of the upper, and two shock-absorbing members 910 are connected at a location corresponding to a heel of a wearer's foot on opposite sides at a rear portion of the upper.

Figure 10A:
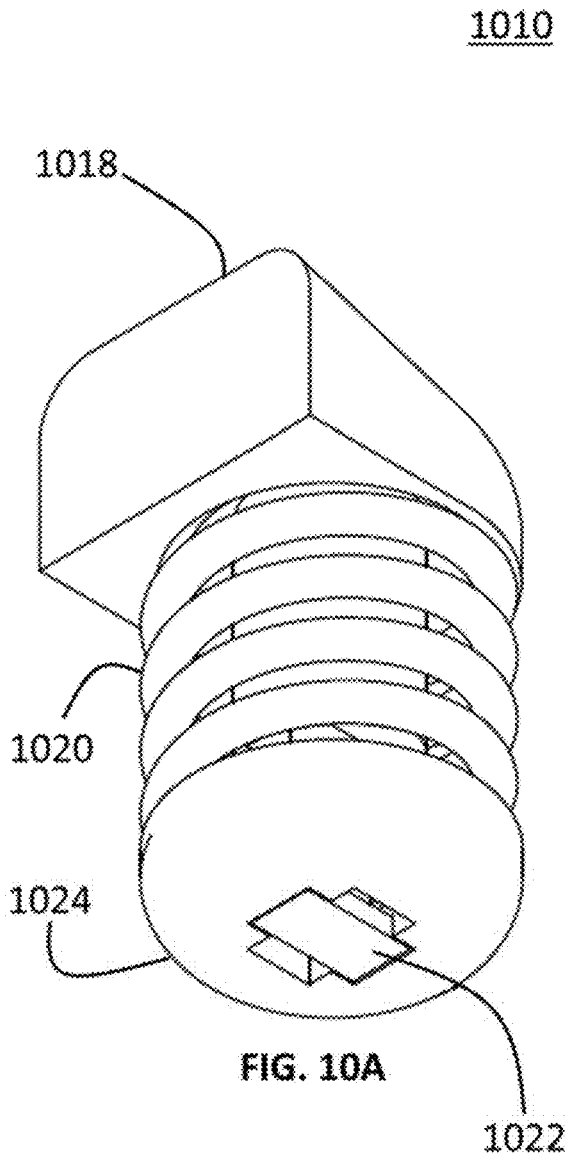
FIG. 10A-B shows various views depicting a shock-absorbing member in accordance with another exemplary embodiment of the present invention.
Figure 10B:
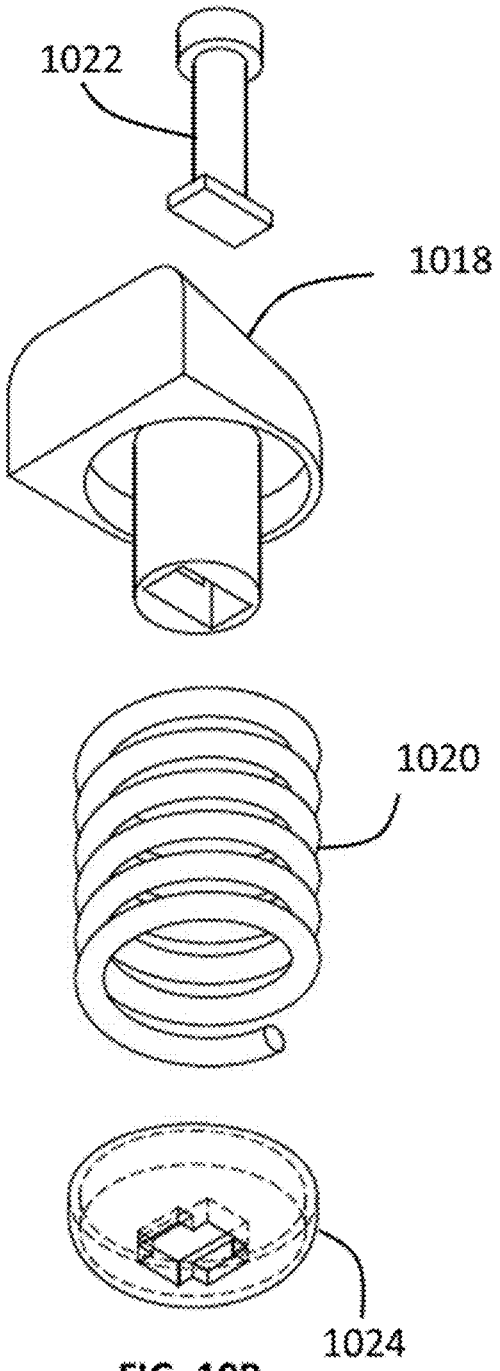

As briefly described herein, the shock-absorbing members may have many different configurations and construction in order to provide the desired amount of shock-absorption for a given application. In one aspect, FIGS. 10A-10B show various views of an exemplary embodiment of a shock-absorbing member 1010 in accordance with the present invention. As shown, the shock-absorbing member comprises a foot 1024, body frame member 1018, pin 1022, and an impact-dampening component 1022. In this embodiment, impact-dampening component 1022 comprises a compression spring system, but can comprise other shock absorbing materials, such as, for example, gels, air, gas, hydraulic, foam, a combination thereof or the like. In further aspects, the foot 1024 can be any structure that contacts the ground or any other surface, and may further comprise a gripping portion that can assist with traction.

Figure 11:
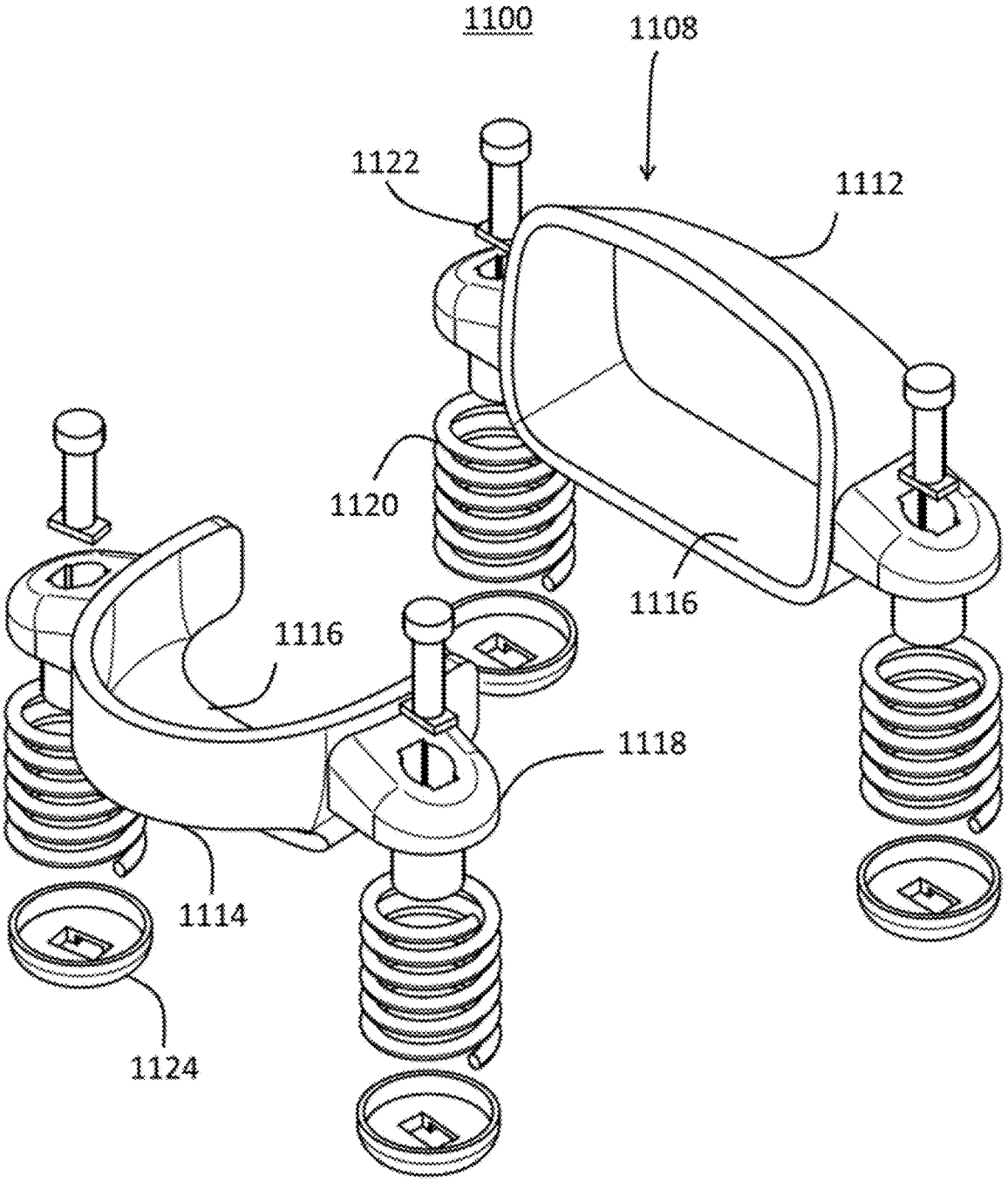
FIG. 11 shows various views depicting a shock-absorbing assembly for use with footwear in accordance with another exemplary embodiment of the present invention.

FIG. 11 shows another exemplary shock-absorbing assembly system 1100 for an article of footwear configured to absorb at least a portion of an applied force upon impact. The system 1100 comprises a plurality of shock-absorbing assemblies comprising a support frame 1108 comprising at least one frame member, the support frame 1108 being configured to detachably connect to at least one of: a portion of a shoe upper and a portion of a sole; and a plurality of shock-absorbing members 1110 having first and second opposed ends, the first end of the shock-absorbing member being connected to a portion of the support frame 1108. As shown in FIG. 10, there is a first shock-absorbing assembly comprising a ball support frame 1112 configured to connect to at least one of a front portion of a shoe upper and a front portion of a shoe sole; and a second shock-absorbing assembly comprising a heel support frame 1114 configured to connect to at least one of a rear portion of a shoe upper and a rear portion of a shoe sole, and each support frame also comprising a sole frame member extending from one end of the support frame to an opposite end. The ball support frame comprises an arcuate shape substantially complementary to a top contour of a wearer's foot corresponding to an area above a ball of the wearer's foot; and the heel support frame 314 comprises an arcuate shape substantially complementary to a rear contour of a wearer's foot corresponding to an area above a heel of the wearer's foot. Two shock-absorbing members 1110 are connected to the ball support frame at an area corresponding to a location of the ball of the wearer's foot; and two shock-absorbing members 1110 are connected to the heel support frame 314 at an area corresponding to a location of the heel of the wearer's foot. Here, the shock-absorbing member comprises a foot 1124, body frame member 1118, pin 1122, and an impact-dampening component 1120 in the form of a compression spring system.

The disclosed shoes devices, systems, and methods of the present invention include at least the following aspects: Aspect 1: A shock-absorbing shoe comprising: a) an upper; b) a sole; and c) at least one shock-absorbing assembly, the shock-absorbing assembly comprising: i) at least one support frame connected to at least a portion of the upper or sole, or a combination thereof, on the outside or the inside or in between and ii) a plurality of shock-absorbing members having first and second opposed ends, the first ends of the shock-absorbing members being connected to a portion of the support frame; wherein the shock-absorbing assembly is configured to absorb at least a portion of an applied force upon impact.

Aspect 2: The shoe of any preceding aspect, wherein the support frame comprises at least a ball portion and a heel portion.

Aspect 3: The shoe of any preceding aspect, wherein the ball portion of the support frame is shaped to be disposed over a top portion of a wearer's foot; and wherein the ball portion of the support frame is disposed over the top of the upper or in between the sole of the shoe, or a combination thereof.

Aspect 4: The shoe of any preceding aspect, wherein the ball portion of the support frame is disposed over a top portion of the upper.

Aspect 5: The shoe of any preceding aspect, wherein the heel portion of the support frame is shaped to be disposed around a back portion of a wearer's foot; and wherein the heel portion of the support frame is also disposed around the back of the upper or in between the sole of the shoe, or a combination thereof.

Aspect 6: The shoe of any preceding aspect, wherein the heel portion of the support frame is shaped to be disposed around a back portion of the upper.

Aspect 7: The shoe of any preceding aspect, wherein at least a portion of the ball portion or heel portion of the support frame extends through the sole, or a combination thereof.

Aspect 8: The shoe of any preceding aspect, wherein the support frame further comprises a sole portion.

Aspect 9: The shoe of any preceding aspect, wherein the ball portion or the heel portion comprise a sole portion, or a combination thereof.

Aspect 10: The shoe of any preceding aspect, wherein the sole portion comprises a frame member extending from one side of the shoe to another side of the shoe.

Aspect 11: The shoe of any preceding aspect, wherein the sole portion is located in an area corresponding to an area under the ball or heel of a wearer's foot, or a combination thereof.

Aspect 12: The shoe of any preceding aspect, wherein the sole portion is integrated within the sole.

Aspect 13: The shoe of any preceding aspect, wherein the heel portion and the ball portion are connected by a frame member.

Aspect 14: The shoe of any preceding aspect, wherein the support frame comprises a plurality of frame members having first and second opposed ends.

Aspect 15: The shoe of any preceding aspect, wherein the support frame comprises a first and second frame member; and wherein at least a portion of each frame member is connected to the upper, or the sole, or a combination thereof.

Aspect 16: The shoe of any preceding aspect, wherein the first frame member comprises a ball frame member.

Aspect 17: The shoe of any preceding aspect, wherein the second frame member comprises a heel frame member.

Aspect 18: The shoe of any preceding aspect, wherein the first and second frame members are not connected.

Aspect 19: The shoe of any preceding aspect, wherein at least one end of the first and second frame members are connected to the upper or the sole, or a combination thereof.

Aspect 20: The shoe of any preceding aspect, wherein both ends of the first and second frame members are connected to different portions of the sole or upper.

Aspect 21: The shoe of any preceding aspect, wherein the support frame comprises a first frame member, a second frame member, and a third frame member, wherein at least a portion of each member may be connected to another member, the upper, or the sole, or a combination thereof.

Aspect 22: The shoe of any preceding aspect, wherein the ball member and heel member are connected by at least one third frame member.

Aspect 23: The shoe of any preceding aspect, wherein at least one end of the ball member and at least one end of the heel member are connected by a third frame member.

Aspect 24: The shoe of any preceding aspect, wherein two ends of the ball member and two ends of the heel member are connected by a third frame member.

Aspect 25: The shoe of any preceding aspect, wherein the ball member and heel member are connected by at least one third frame member.

Aspect 26: The shoe of any preceding aspect, wherein at least a portion of the first and third frame members are connected to the second frame member, upper or the sole, or a combination thereof.

Aspect 27: The shoe of any preceding aspect, wherein at least one end of the first and third frame members are connected the upper or the sole, or a combination thereof; and a middle portion of the first and third frame members are connected to a portion of the second frame member.

Aspect 28: The shoe of any preceding aspect, wherein at least a portion of the second frame member is connected to the first frame member, third frame member, upper, or sole, or a combination thereof.

Aspect 29: The shoe of any preceding aspect, wherein at least one end of the second frame member is connected to the first frame member, third frame member, upper, or sole, or a combination thereof.

Aspect 30: The shoe of any preceding aspect, wherein at least one end of the second frame member is connected to the first frame member, third frame member, upper, or sole, or a combination thereof, and wherein a middle portion of the second frame member is connected to the first or second frame members, or a combination thereof.

Aspect 31: The shoe of any preceding aspect, wherein a first end of the second frame member is connected to a first end of first frame member and a second end of the second frame member is connected to a first end of the third frame member.

Aspect 32: The shoe of any preceding aspect, wherein a first end of the second frame member is connected to a first end of first frame member and a second end of the second frame member is connected to a first end of the third frame member; and wherein a second end of first frame member is connected to a first portion of the sole and a second end of the third frame member is connected to a second portion of the sole.

Aspect 33: The shoe of any preceding aspect, wherein at least a portion of the first frame member, the second frame member, or the third frame member have an arcuate shape.

Aspect 34: The shoe of any preceding aspect, wherein at least a portion of the first frame member, the second frame member, and the third frame member have an arcuate shape.

Aspect 35: The shoe of any preceding aspect, wherein a middle portion of the second frame member has an arcuate shape.

Aspect 36: The shoe of any preceding aspect, wherein a middle portion of the second frame member has an arcuate shape, and a portion of the first and second ends of the second frame member each extend toward a predetermined direction at a predetermined angle.

Aspect 37: Wherein the portion of first and second ends of the second frame member each extend away from the remaining portion of the member at an angle in the range of from about 15 degrees to about 120 degrees.

Aspect 38: The shoe of any preceding aspect, further comprising a heel support frame having at least one shock-absorbing member connected to a portion of the heel support frame; wherein the heel support frame is connected to at least a portion of the rear upper or rear sole, or a combination thereof.

Aspect 39: The shoe of any preceding aspect, wherein the support frame at the front, heel and middle is connected to upper on the inside, outside or disposed between inner and outer surfaces of the upper; and wherein a at least a portion of the support frame is also connected to the sole on the outside or inside or between the inner and outer surfaces.

Aspect 40: The shoe of any preceding aspect, wherein the support frame is connected to an inner surface of the upper.

Aspect 41: The shoe of any preceding aspect, wherein the support frame is integrally connected between an outer surface and inner surface of the upper.

Aspect 42: The shoe of any preceding aspect, wherein the heel support frame is connected to an outer surface of the upper.

Aspect 43: The shoe of any preceding aspect, wherein the heel support frame is connected to an inner surface of the upper.

Aspect 44: The shoe of any preceding aspect, wherein the heel support frame is integrally connected between an outer surface and inner surface of the upper.

Aspect 45: The shoe of any preceding aspect, wherein the support frame further comprise a plurality of apertures configured to receive a shoelace.

Aspect 46: The shoe of any preceding aspect, wherein at least a portion of the support frame is positioned on the upper in a location corresponding to a lacing portion of the upper.

Aspect 47: The shoe of any preceding aspect, wherein the support frame is configured to form an opening or lacing gap on the upper.

Aspect 48: The shoe of any preceding aspect, further comprising a tongue configured and sized to fill the lacing gap.

Aspect 49: The shoe of any preceding aspect, wherein the rotational position of the shock absorbing member can be configured or changed with respect to the upper and sole to permit changes to the impact-attenuation characteristics of the overall article of footwear or other foot-receiving device.

Aspect 50: The shoe of any preceding aspect, wherein one or more shock-absorbing members are each connected to a portion of the support frame by the first end of the shock-absorbing members at a location corresponding to a front portion or rear portion of the shoe upper, or at a location corresponding to the ball or heel of wearer's foot, or a combination thereof.

Aspect 51: The shoe of any preceding aspect, wherein the shock-absorbing members are each connected by a first end of the shock-absorbing members.

Aspect 52: The shoe of any preceding aspect, wherein the plurality of shock-absorbing members each extend away from the connection point.

Aspect 53: The shoe of any preceding aspect, wherein at least one shock-absorbing member is connected to the support frame at a location corresponding to an upper portion of the upper.

Aspect 54: The shoe of any preceding aspect, wherein at least one shock-absorbing member is connected to the support frame at an upper portion of the upper adjacent to a location corresponding to a ball of a wearer's foot.

Aspect 55: The shoe of any preceding aspect, wherein at least two shock-absorbing members are connected to the support frame at an upper portion of the upper adjacent to a location corresponding to a ball of a wearer's foot.

Aspect 56: The shoe of any preceding aspect, wherein the two shock-absorbing members are connected on opposite sides of the upper.

Aspect 57: The shoe of any preceding aspect, wherein at least one shock-absorbing member is connected to a rear portion of the upper.

Aspect 58: The shoe of any preceding aspect, wherein at least one shock-absorbing member is connected to a heel support frame at a rear portion of the upper adjacent to a location corresponding to a heel of a wearer's foot.

Aspect 59: The shoe of any preceding aspect, wherein at least two shock-absorbing members are connected to the support frame at an upper portion of the upper adjacent to a location corresponding to a ball of a wearer's foot; and wherein at least one shock-absorbing member is connected to a heel support frame at a rear portion of the upper adjacent to a location corresponding to a heel of a wearer's foot.

Aspect 60: The shoe of any preceding aspect, wherein the shock-absorbing members comprise a plurality of connection points for attaching to the shoe.

Aspect 61: The shoe of any preceding aspect, wherein the shock-absorbing assembly comprises a first, second, and third shock-absorbing member.

Aspect 62: The shoe of any preceding aspect, wherein the second end of the shock-absorbing members comprise a surface-contacting portion configured to contact the ground.

Aspect 63: The shoe of any preceding aspect, wherein the surface-contacting portion is configured or angled to maximize surface area contact with a surface when the shoe is moved toward the surface.

Aspect 64: The shoe of any preceding aspect, wherein the shock-absorbing members extend down from the upper beyond an outermost surface of the sole.

Aspect 65: The shoe of any preceding aspect, wherein the second ends of shock-absorbing members extend a predetermined distance beyond an outermost surface of the sole.

Aspect 66: The shoe of any preceding aspect, wherein the predetermined distance is from about 1 cm to about 20 cm.

Aspect 67: The shoe of any preceding aspect, wherein the shock-absorbing member comprises at least one foot, leg or body member, a combination thereof.

Aspect 68: The shoe of any preceding aspect, wherein the shock-absorbing member comprises an impact-dampening component configured to attenuate a force.

Aspect 69: The shoe of any preceding aspect, wherein the shock-absorbing member can be configured to have any desired level of impact attenuation.

Aspect 70: The shoe of any preceding aspect, wherein the level of impact attenuation comprises from about 10% to about 90% reduction in ground reaction forces.

Aspect 71: The shoe of any preceding aspect, wherein the impact-dampening component is a spring, shock, compressible foam, columnar and telescoping structure, a biasing system, Air, gas, Hydraulic, Gel, liquid or a combination thereof or combinations thereof.

Aspect 72: The shoe of any preceding aspect, wherein the body member could be a cylindrical tube, semi cylindrical tube, an enclosed chamber capable and configured to hold the impact-dampening material.

Aspect 73: The shoe of any preceding aspect, wherein the shock-absorbing member comprises an extended position and a compressed position.

Aspect 74: The shoe of any preceding aspect, wherein the leg or body member are configured to compress or flatten out to a compressed position under an impact force applied to a base or foot portion (e.g., from landing a step or jump)

Aspect 75: The shoe of any preceding aspect, wherein the shock absorbing members are configured to return back to an extended position or toward its original size, shape, and orientation once the impact force is removed or relieved.

Aspect 76: The shoe of any preceding aspect, wherein the foot is a structure that contacts the ground or any other surface.

Aspect 77: The shoe of any preceding aspect, wherein the foot comprises a gripping portion.

Aspect 78: The shoe of any preceding aspect, wherein the gripping portion is substantially flat.

Aspect 79: The shoe of any preceding aspect, wherein the gripping portion is pivotally connected.

Aspect 80: The shoe of any preceding aspect, wherein the gripping portion comprises a compressible material.

Aspect 81: The shoe of any preceding aspect, wherein the shock-absorbing member and foot are comprised of suitable and conventional materials configured to provide long wear, traction, and protect the foot and/or to prevent the remainder of the footwear or foot-receiving device structure from impacts effects when contacting the ground or other surface in use.

Aspect 82: The shoe of any preceding aspect, wherein the support frame is selected from a wide variety of relatively stiff, but pliable materials, such as steel, aluminum, and the like.

Aspect 83: The shoe of any preceding aspect, wherein the support frame is comprised of metal, thermoplastic resin, ceramic, rigid plastic material, reinforced plastic or composite materials, alloys, carbon fiber, textile, wood or combinations thereof.

Aspect 84: The shoe of any preceding aspect, wherein the upper is comprised of fabric, cloth, plastic, woven or non-woven, natural or synthetic, leather, plastic, polyurethane, faux or polyurethane leather, nylon, cotton, textile or combinations thereof.

Aspect 85: The shoe of any preceding aspect, wherein the sole comprises an upper layer and lower layer.

Aspect 86: The shoe of any preceding aspect, wherein the sole is configured to attach to a portion of the first, second and third support frames.

Aspect 87: The shoe of any preceding aspect, wherein the first, second and third support frames are configured to attach between an upper layer and lower layer of the sole.

Aspect 88: The shoe of any preceding aspect, wherein the sole is comprised of synthetic, leather, cotton, nylon, foam, rubber, shock-absorbing assemblies, connecting means, plastic, textile or combinations thereof.

Aspect 89: The shoe of any preceding aspect, wherein a shoe component is connected by a connecting means.

Aspect 90: The shoe of any preceding aspect, wherein the support frame is connected by a connecting means, the connecting means comprising a fitting, insert, adhesive, brazing, soldering, welding, spot weld, screw with nut, rivet, threading, friction fit, snap-fit, twist-lock, or interlocking mechanism or a combination thereof.

Aspect 91: The shoe of any proceeding aspect, wherein the second ends of shock-absorbing members can be connected using a bridge, such as an elongated member.

Aspect 92: A shock-absorbing assembly for an article of footwear, the shock-absorbing assembly comprising: a) a support frame configured to connect to at least a portion of the article of footwear, and b) a plurality of shock-absorbing members having first and second opposed ends, the first ends of the shock-absorbing members being connected to a portion of the support frame.

Aspect 93: A method for dampening an applied force to a joint; the method comprising: a) providing an article of footwear having a shock-absorbing assembly, the shock-absorbing assembly comprising: i) a support frame configured to connect to at least a portion of the article of footwear, and ii) a plurality of shock-absorbing members having first and second opposed ends, the first ends of the shock-absorbing members being connected to a portion of the support frame.

Aspect 94: The method of any previous aspect, further comprising walking using the article of footwear.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A shock-absorbing shoe comprising:

a) an upper;

b) a sole; and c) at least one shock-absorbing assembly, the shock-absorbing assembly comprising:

i) at least one support frame connected to at least a portion of the upper or sole, or a combination thereof, and ii) a plurality of shock-absorbing members having first and second opposed ends, the first ends of the shock-absorbing members being connected to a portion of the support frame at a location corresponding to an upper portion of the upper and extending from the upper beyond an outermost surface of the sole;

wherein the plurality of shock-absorbing members is positioned outside of the sole;

wherein the shock-absorbing assembly is configured to absorb at least a portion of an applied force upon impact; and wherein the at least one shock-absorbing assembly is configured to utilize the force from compressing the plurality of shock-absorbing members to pull the shoe upward.

2. The shoe of claim 1, wherein the support frame comprises a ball portion and a heel portion.

3. The shoe of claim 2, wherein the ball portion of the support frame is shaped to be disposed over a top portion of a wearer's foot; and wherein the ball portion of the support frame is disposed on at least one of: an outer surface of the top portion of the upper and within the sole of the shoe.

4. The shoe of claim 3, wherein the heel portion of the support frame is shaped to be disposed around a rear portion of a wearer's foot; and wherein the heel portion of the support frame is disposed on at least one of an outer surface of the rear portion of the upper or within the sole of the shoe.

5. The shoe of claim 4, wherein the heel portion and the ball portion are connected by a frame member.

6. The shoe of claim 4, wherein the support frame further comprises at least one sole portion, the sole portion being configured to extend from one side of the shoe through the sole to an opposite side of the shoe.

7. The shoe of claim 4, wherein at least two shock-absorbing members are connected to the ball portion at a location corresponding to a ball of a wearer's foot; and wherein at least one shock-absorbing member is connected to the heel portion at a rear portion of the upper adjacent to a location corresponding to a heel of a wearer's foot.

8. The shoe of claim 7, wherein the shock-absorbing member comprises at least one of: a foot, body member, and impact-dampening component.

9. The shoe of claim 8, wherein the impact-dampening component comprises a spring, shock, compressible foam, columnar and telescoping structure, a biasing system, air, gas, hydraulic liquid, and gel.

10. The shoe of claim 9, wherein the shock-absorbing member is configured to go from an extended position to a compressed position.

11. A shock-absorbing shoe comprising:

a) an upper;

b) a sole having an upper portion; and c) a plurality of shock-absorbing assemblies, the shock-absorbing assemblies comprising:

i) a support frame comprising at least one frame member, the support frame being connected to at least one of: a portion of the upper and a portion of the sole, and ii) at least one shock-absorbing member having first and second opposed ends, the first end of the shock-absorbing member being connected to a portion of the support frame at a location corresponding to an upper portion of the upper and extending from the upper beyond an outermost surface of the sole;

wherein the plurality of shock-absorbing members is positioned outside of the sole:

wherein the shock-absorbing assemblies are configured to absorb at least a portion of an applied force upon impact; and wherein the shock-absorbing assemblies are configured to utilize the force from compressing the plurality of shock-absorbing members to pull the shoe upwards.

12. The shoe of claim 11, wherein the shoe comprises a first shock-absorbing assembly comprising a ball support frame configured to connect to at least one of a front portion of the upper and a front portion of the sole; and a second shock-absorbing assembly comprising a heel support frame configured to connect to at least one of a rear portion of the upper and a rear portion of the sole; wherein the ball support frame comprises an arcuate shape substantially complementary to a top contour of a wearer's foot corresponding to an area above a ball of the wearer's foot; and;

wherein the heel support frame comprises an arcuate shape substantially complementary to a rear contour of a wearer's foot corresponding to an area above a heel of the wearer's foot.

13. The shoe of claim 11, where the support frame comprises a sole frame member extending from one end of the support frame to an opposite end.

14. The shoe of claim 13, wherein at least a portion of the support frame is connected to at least one of: an outer surface of the upper, an inner surface of the upper, and between inner and outer surfaces of the upper; and wherein at least a portion of the support frame is connected to at least one of: an outer surface of the sole, an inner surface of the sole, and between first and second layers of the sole.

15. The shoe of claim 12, wherein at least two shock-absorbing members are connected to the ball support frame at an area corresponding to a location of the ball of the wearer's foot; and wherein at least two shock-absorbing members are connected to the heel support frame at an area corresponding to a location of the heel of the wearer's foot.

16. The shoe of claim 15, wherein the sole and second ends of the shock-absorbing members are both configured to make direct contact with a ground surface; and wherein the second ends of the shock-absorbing members are configured to be first points of contact with the ground surface before the sole contacts the ground surface during walking.

17. A method for dampening an applied force to a joint during locomotion, the method comprising:

a) providing the shock-absorbing shoe of claim 15; and b) using the shock-absorbing shoe in connection with locomotion.

18. The shoe of claim 1, wherein the sole and second ends of the shock-absorbing members are both configured to make direct contact with a ground surface; and wherein the second ends of the shock-absorbing members are configured to be first points of contact with the ground surface before the sole contacts the ground surface during walking.

* * * * *